US011081073B2

(12) United States Patent
Hasegawa et al.

(10) Patent No.: US 11,081,073 B2
(45) Date of Patent: Aug. 3, 2021

(54) LIQUID CRYSTAL DISPLAY APPARATUS

(71) Applicant: SAKAI DISPLAY PRODUCTS CORPORATION, Sakai (JP)

(72) Inventors: Koji Hasegawa, Sakai (JP); Yoshitaka Okumoto, Sakai (JP); Tokuyoshi Awa, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/821,693

(22) Filed: Mar. 17, 2020

(65) Prior Publication Data

US 2020/0342826 A1 Oct. 29, 2020

Related U.S. Application Data

(60) Provisional application No. 62/838,497, filed on Apr. 25, 2019.

(51) Int. Cl.
*G09G 3/36* (2006.01)

(52) U.S. Cl.
CPC ..... *G09G 3/3648* (2013.01); *G09G 3/3614* (2013.01); *G09G 3/3674* (2013.01); *G09G 3/3685* (2013.01); *G09G 2300/0439* (2013.01)

(58) Field of Classification Search
None
See application file for complete search history.

(56) References Cited

U.S. PATENT DOCUMENTS

2008/0165299 A1* 7/2008 Huang ..... G09G 3/3659 349/38
2009/0002585 A1 1/2009 Shimoshikiryoh et al.
2012/0057091 A1 3/2012 Kawabata et al.
2014/0146265 A1 5/2014 Nakamizo et al.
2014/0368762 A1 12/2014 Kawabata et al.

FOREIGN PATENT DOCUMENTS

WO 2006/098449 A1 9/2006
WO 2010/134439 A1 11/2010
WO 2013/018637 A1 2/2013

* cited by examiner

*Primary Examiner* — Carl Adams
(74) *Attorney, Agent, or Firm* — ScienBiziP, P.C.

(57) ABSTRACT

A liquid crystal display apparatus is disclosed. In the liquid crystal display apparatus, a first pixel of a plurality of pixels arranged in a matrix comprises a first sub-pixel and a second sub-pixel. The first sub-pixel and the second sub-pixel are connected to a first scanning line of a plurality of scanning lines, to which the first scanning line is supplied a first scanning signal. A first potential is supplied to a first auxiliary capacitance of the first sub-pixel based on a first control signal to select any of a plurality of row pixel groups after the first scanning signal. A second potential being different from the first potential is supplied to a second auxiliary capacitance of the second sub-pixel based on a second control signal to select any one of a plurality of row pixel groups after the first scanning signal.

16 Claims, 10 Drawing Sheets

LIQUID CRYSTAL DISPLAY APPARATUS

CROSS-REFERENCE TO RELATED APPLICATIONS

This application claims priority to and the benefit of priority of U.S. Provisional Application No. 62/838,497, filed on Apr. 25, 2019, the entire contents of which are incorporated herein by reference.

BACKGROUND

Technical Field

The present disclosure relates to a liquid crystal display apparatus.

Description of Related Art

In the liquid crystal display apparatus, a pixel division scheme can be adopted to make an improvement on the problem of viewing angle dependency in which how a screen is viewed varies with viewing directions. In the pixel division scheme, each of a plurality of pixels being arranged in a matrix is divided into a plurality of sub-pixels. In the plurality of sub-pixels in the same pixel, alignment directions of liquid crystal molecules are controlled such that they are different from one another.

WO2006/098449 discloses a liquid crystal display apparatus using the pixel division scheme in which a plurality of electrically independent auxiliary capacitance trunk wirings are provided. One sub-pixel comprises a liquid crystal capacitance to apply a data potential to a liquid crystal layer and an auxiliary capacitance to hold the data potential, the auxiliary capacitance being connected to the liquid crystal capacitance, wherein mutually different potentials are supplied to the auxiliary capacitances of a plurality of sub-pixels comprised in the same pixel. Each of the plurality of auxiliary capacitance trunk wirings is electrically connected via an auxiliary capacitance wiring to any of the auxiliary capacitances of the plurality of sub-pixels comprised in the same pixel. Then, mutually different oscillatory potentials are supplied to the plurality of auxiliary capacitance trunk wirings to supply mutually different potentials to the auxiliary capacitances of the plurality of sub-pixels comprised in the same pixel. In this way, the viewing angle dependency of the liquid crystal display apparatus is improved.

SUMMARY

In the liquid crystal display apparatus disclosed in the above-mentioned document, in order to improve the viewing angle dependency, different oscillatory potentials need to be supplied to the auxiliary capacitances of the plurality of sub-pixels thereof at optimal timings for each of the plurality of pixels. In order to do so, oscillatory potentials of plurality of phases (for example, six to twelve phases) having different phases needs to be supplied to respective of them and a number of auxiliary capacitance trunk wirings, the number being the number of phases of oscillatory potential to be supplied, are needed. The auxiliary capacitance trunk wiring is normally arranged in a frame portion of the liquid crystal display apparatus so as not to block light from a backlight. Therefore, an increase in the number of auxiliary capacitance trunk wirings causes an increase in the frame width of the liquid crystal display apparatus.

In order to avoid the problem of the increase in the frame width of the liquid crystal display apparatus, it is considered to adopt a short-period oscillatory potential such as to change in level multiple times in one frame period of video data and supply the above-mentioned oscillatory potential to a plurality of auxiliary capacitance wirings. However, making the change in level of the oscillatory potential to occur in a short period increases load on the auxiliary capacitance wiring, causing rounding to occur in the waveform of the oscillatory potential. Rounding occurring in the waveform of the oscillatory potential causes luminance errors to be produced in a sub-pixel, causing the display definition of the liquid crystal display apparatus to deteriorate.

To suppress rounding of the oscillatory potential, it is considered to arrange the auxiliary capacitances wiring in both the row direction and the column direction of a pixel matrix, and thereby, to increase the number of auxiliary capacitance wirings to supply one oscillatory potential. However, light from a backlight is blocked in a region in which the auxiliary capacitance wiring is arranged, causing the ratio in area between a display region and a region being effective in displaying (below called "aperture ratio") to decrease.

In this way, in a liquid crystal display apparatus to supply mutually different oscillatory potentials to each of auxiliary capacitances of a plurality of sub-pixels comprised in one pixel to improve the viewing angle dependency, it is difficult to supply different oscillatory potentials at timings optimal for each of the auxiliary capacitances of the plurality of sub-pixels without inviting an increase in the frame width of the liquid crystal display apparatus, deterioration in the display definition, or a decrease in the aperture ratio.

A liquid crystal display apparatus being one Embodiment of the present disclosure comprises a plurality of pixels arranged in a matrix; a plurality of scanning lines, each of the plurality of scanning lines being connected to a row pixel group arranged in the row direction of the plurality of pixels, to which plurality of scanning lines is successively supplied a scanning signal to select the row pixel group; and a plurality of data lines, each of the plurality of data lines being connected to a column pixel group arranged in the column direction of the plurality of pixels, to which plurality of data lines is supplied a data signal to supply, to the column pixel group, a potential based on video data, wherein a first pixel of the plurality of pixels comprises a first sub-pixel and a second sub-pixel; the first sub-pixel and the second sub-pixel are connected to a first scanning line of the plurality of scanning lines, to which first scanning line is supplied a first scanning signal; the first sub-pixel comprises a first liquid crystal capacitance and a first auxiliary capacitance, the first liquid crystal capacitance to be selectively connected to a first data line of the plurality of data lines based on the first scanning signal and the first auxiliary capacitance being connected to the first liquid crystal capacitance, and a first potential is supplied to the first auxiliary capacitance based on a first control signal being a scanning signal to select any one of the plurality of row pixel groups after the first scanning signal; and the second sub-pixel comprises a second liquid crystal capacitance and a second auxiliary capacitance, the second liquid crystal capacitance to be selectively connected to the first data line based on the first scanning signal and the second auxiliary capacitance being connected to the second liquid crystal capacitance; and a second potential being different from the first potential is supplied to the second auxiliary capacitance based on a second control signal being a scanning signal to select any one of the plurality of row pixel groups after the first scanning signal.

The liquid crystal display apparatus being an Embodiment of the present disclosure can supply different oscillatory potentials (the first potential and the second potential) at a timing suitable for each of auxiliary capacitances of a plurality of sub-pixels comprised in one pixel (first pixel) without inviting an increase in a frame width, a decrease in the display definition, or a decrease in the aperture ratio of the liquid crystal display apparatus.

DETAILED DESCRIPTION

Below, with reference to the drawings, Embodiments of the present disclosure will be explained. It is to be noted that the same reference signs are given to portions having the same functions in each of the drawings.

Configuration of Liquid Crystal Display Apparatus According to Embodiment 1

Figure 1A:
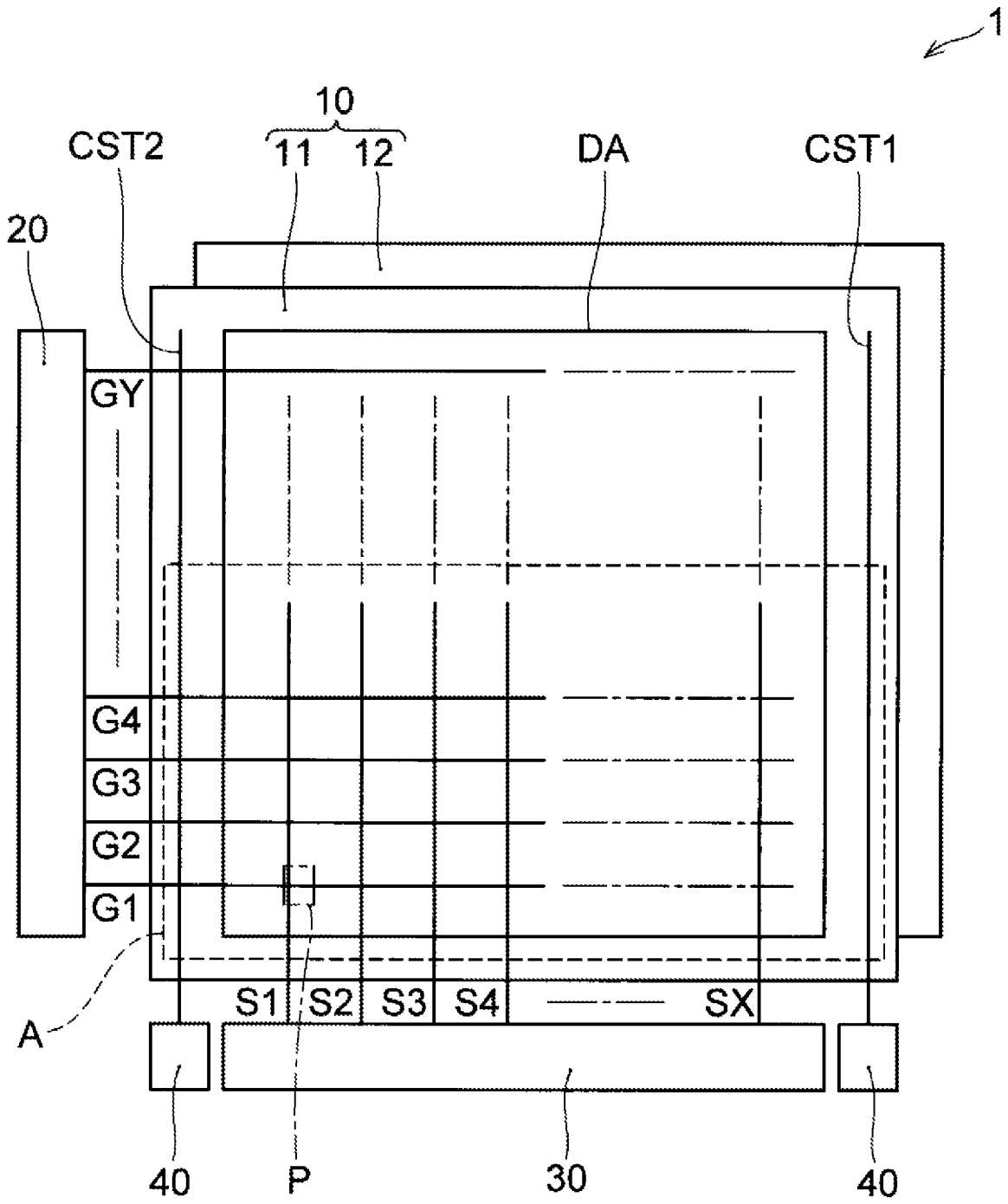
FIG. 1A schematically shows a block diagram of a configuration of a liquid crystal display apparatus according to Embodiment 1.

FIG. 1A schematically shows a block diagram of a configuration of a liquid crystal display apparatus according to Embodiment 1. In FIG. 1A, the liquid crystal display apparatus is viewed from a surface being opposite to a display surface to display an image. A liquid crystal display apparatus 1 according to the present Embodiment comprises a liquid crystal display panel 10, a scanning line drive unit 20, a data line drive unit 30, and an auxiliary capacitance line drive unit 40.

The liquid crystal display panel 10 comprises a pair of glass substrates 11 and 12, and liquid crystal layers P123, P223 (see FIG. 1B) being provided between the glass substrate 11 and the glass substrate 12.

The one glass substrate 11 comprises, in a display region DA of the liquid display panel 10, for example, a plurality of scanning lines G1 to GY extending in the row direction and being lined up in the column direction with the plurality of scanning lines being Y in number; a plurality of data lines S1 to SX, extending in the column direction and being lined up in the row direction with the plurality of data lines being X in number; and a pixel P being provided in correspondence with each intersection of the plurality of scanning lines G1 to GY and the plurality of data lines S1 to SX and being arranged in a matrix, and so on. The plurality of scanning lines G1 to GY are each connected to a pixel group being lined up in the row direction (below-called "a row pixel group"), while the plurality of data lines S1 to SX are each connected to a pixel group being lined up in the column direction (below-called "a column pixel group"). Each pixel P causes a color filter to be described below to transmit light from a backlight to display either of R (red), G (green), and B (blue). Moreover, in non-display regions at the exterior of the display region DA, the non-display regions being opposite ends in the row direction of the glass substrate 11, are respectively provided a first auxiliary capacitance trunk wiring CST1 and a second auxiliary capacitance trunk wiring CST2.

Below, the pixel P being provided in correspondence with the intersection between a n-th row scanning line Gn and a m-th column data line Sm is also called P (m, n). P (m, n) is also used at the time of focusing on an arbitrary pixel in the liquid crystal display panel 10. Moreover, the row pixel group being connected to the n-th row scanning line Gn is also called P (1, n) to P (X, n), while the column pixel group being connected to the m-th column data line Sm is also called P (m, 1) to P (m, Y). P (1, n) to P (X, n) is also used at the time of focusing on an arbitrary row pixel group in the liquid crystal display panel 10, while P (m, 1) to P (m, Y) is also used at the time of focusing on an arbitrary column pixel group in the liquid crystal display panel 10. The first-row row pixel group is also called P (1, 1) to P (X, 1), for example, while the first-column column pixel group is also called P (1, 1) to P (1, Y), for example.

The other glass substrate 12 comprises color filters (not shown) comprising a red color filter, a green color filter, and a blue color filter being arranged in correspondence with each of the pixels P of the one glass substrate 11, and comprises, in the display region DA of the liquid display panel 10, counter electrodes P122, P222 (see FIG. 1B) being provided in common to all of the pixels P, for example.

The scanning line drive unit 20 generates a pulse of a scanning signal to select any one of a plurality of row pixel groups for each one horizontal scanning period (below called "1H") in order to select all of the plurality of row pixel groups in one frame period (below called "1F") and successively outputs the generated the pulse of the scanning signal to the plurality of scanning lines G1 to GY. 1F is to refer to a period from the time at which a data signal corresponding to one frame of image data starts to be supplied to the data lines S1 to SX to the time at which a data signal corresponding to the following one frame of image data starts to be supplied to the data lines S1 to SX in order to display one frame of image data comprised in video data. Moreover, 1H is to refer to a period from the time of selecting a certain scanning line Gn to the time of selecting the following scanning line Gn+1 in each 1F. As a scheme for driving the scanning line drive unit 20, a single pulse scheme can be adopted in which a pulse of scanning signal is supplied only during a main-charge period to supply a data signal to the pixels P from the data lines S1 to SX, or a double pulse scheme can be adopted in which a pulse of scanning signal is supplied not only in the main-charge period, but also in a pre-charge period being the timing previous to the main-charge period.

In order to simultaneously output data signals corresponding to 1H to the data lines S1 to SX, the data line drive unit 30 outputs, to the data lines S1 to SX, the data signals to supply the potential based on video data to each pixel P of the row pixel group selected by the scanning signal. More specifically, the data line drive unit 30 converts the video data from serial digital signals to a plurality of parallel analog signals (data signals) and outputs the data signals to the data lines S1 to SX, respectively. In the present Embodiment, a so-called frame inversion scheme is adopted in which the polarity of the data signal with respect to the counter electrodes P122 and P222 changes between the positive polarity and the negative polarity for each 1F.

The auxiliary capacitance line drive unit 40 supplies a first potential and a second potential being mutually different oscillatory potentials to the first auxiliary capacitance trunk wiring CST1 and the second auxiliary capacitance trunk wiring CST2, respectively, CST1 and CST2 being two auxiliary capacitance trunk wirings. The first auxiliary capacitance trunk wiring CST1 and the second auxiliary capacitance trunk wiring CST2 are arranged in non-display regions (frame edge portions of the liquid crystal display apparatus 1) at the exterior of the display region DA, the non-display regions being opposite ends in the row direction of the glass substrate 11. The first auxiliary capacitance trunk wiring CST1 and the second auxiliary capacitance trunk wiring CST2 being arranged in the non-display regions, not in the display region, allows a decrease in the aperture ratio to be suppressed. In the present Embodiment, the first potential and the second potential changes between low level and high level for each 1F being a relatively long period, respectively. The second potential is supplied such that it takes high level in the period in which the first potential takes low level, and it takes low level in the period in which the first potential takes high level. While a potential of the first potential being low level and a potential of the second potential being low level, and a potential of the first potential being high level and a potential of the second potential being high level can be respectively different, it is preferable that they be respectively the same potential. In a case that they are the same potential, the configuration of the auxiliary capacitance line drive unit 40 can be further simplified, and the number of components making up the liquid crystal display apparatus 1 can be reduced. In this way, manufacturing costs of the liquid crystal display apparatus 1 can be reduced.

Figure 1B:
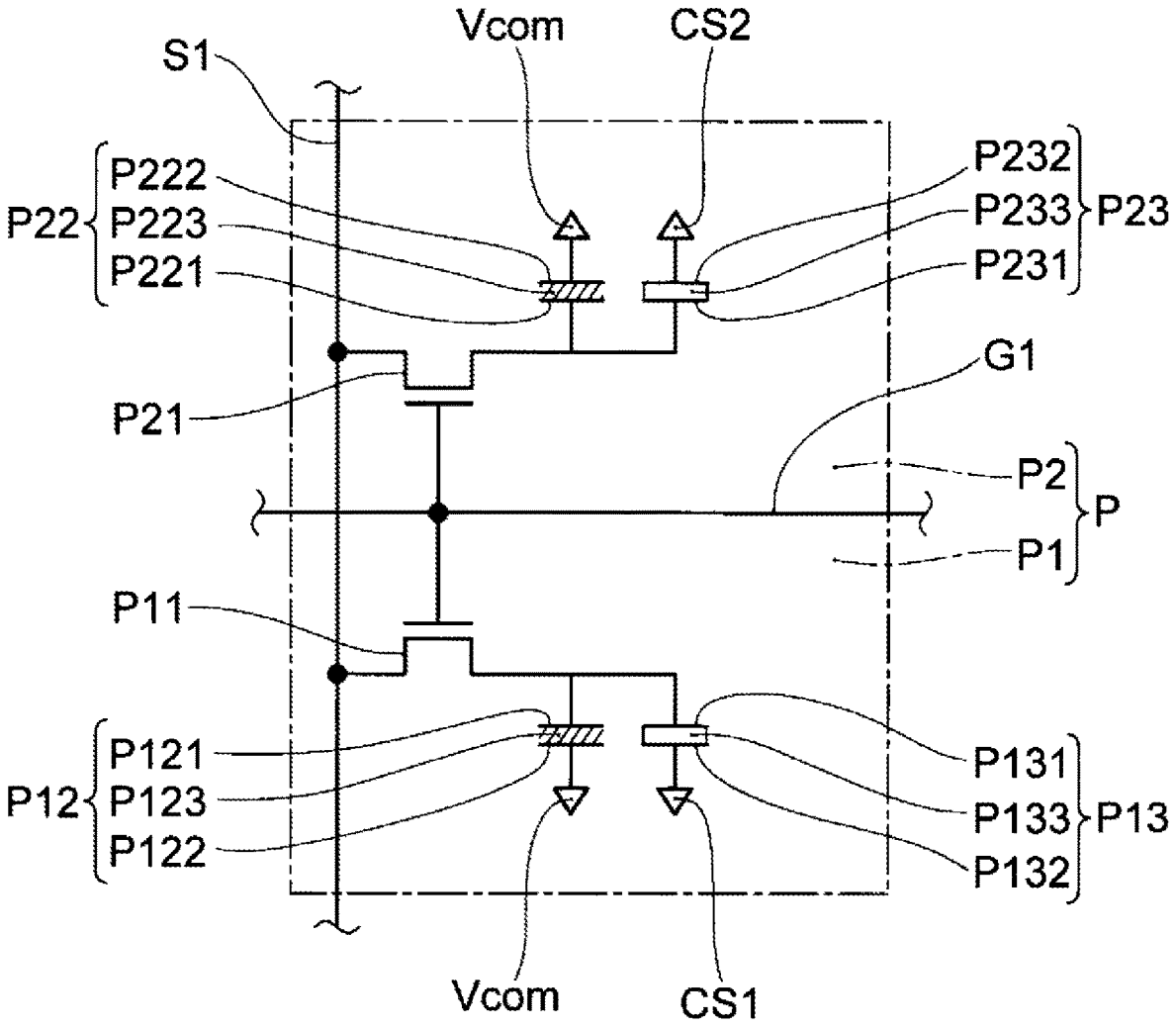
FIG. 1B schematically shows a circuit diagram of a configuration of one pixel P shown in FIG. 1A.

FIG. 1B is a circuit diagram schematically showing a circuit configuration of the one pixel P shown in FIG. 1A. Here, as an example, a pixel P (1, 1) is shown, the pixel P (1, 1) corresponding to the intersection between the scanning line G1 and the data line S1. Each of arbitrary pixels P (m, n) being arranged in a matrix comprises a first sub-pixel P1 and a second sub-pixel P2.

Each circuit making up the first sub-pixel P1 comprises a first switching element P11, a first liquid crystal capacitance P12, and a first auxiliary capacitance P13, and so on. Likewise, each circuit making up the second sub-pixel P2 comprises a second switching element P21, a second liquid crystal capacitance P22, and a second auxiliary capacitance P23, and so on.

The first switching element P11 and the second switching element P21 each comprise a TFT (thin film transistor), for example. The gate electrode of the first switching element P11 is connected to the scanning line G1, while the source electrode of the first switching element P11 is connected to the data line S1. Likewise, the gate electrode of the second switching element P21 is connected to the scanning line G1, while the source electrode of the second switching element P21 is connected to the data line S1.

The first liquid crystal capacitance P12 and the second liquid crystal capacitance P22 each comprises a capacitor in which the liquid crystal layer P123 or P223 is sandwiched by a pair of electrodes comprising a pixel electrode P121 or P221 and the counter electrode P122 or P222, for example. The pixel electrode P121 of the first liquid crystal capacitance P12 is connected to the drain electrode of the first switching element P11, while a common voltage Vcom is applied to the counter electrode P122 of the first liquid crystal capacitance P12. The pixel electrode P221 of the second liquid crystal capacitance P22 is connected to the drain electrode of the second switching element P21, while the common voltage Vcom is applied to the counter electrode P222 of the second liquid crystal capacitance P22.

The first auxiliary capacitance P13 and the second auxiliary capacitance P23 each comprises a capacitor in which an insulating layer P133 or P233 is sandwiched by a pair of electrodes each comprising an auxiliary capacitance electrode P131 or P231 and an auxiliary capacitance counter electrode P132 or P232, for example. The auxiliary capacitance electrode P131 of the first auxiliary capacitance P13 is connected to the drain electrode of the first switching element P11 so that the first auxiliary capacitance P13 is connected to the first liquid crystal capacitance P12. The auxiliary capacitance counter electrode P132 of the first auxiliary capacitance P13 is connected to an auxiliary capacitance wiring CS1. Likewise, the auxiliary capacitance electrode P231 of the second auxiliary capacitance P23 is connected to the drain electrode of the second switching element P21 so that the second auxiliary capacitance P23 is connected to the second liquid crystal capacitance P22. The auxiliary capacitance counter electrode P232 of the second auxiliary capacitance P23 is connected to an auxiliary capacitance wiring CS2.

Figure 2:
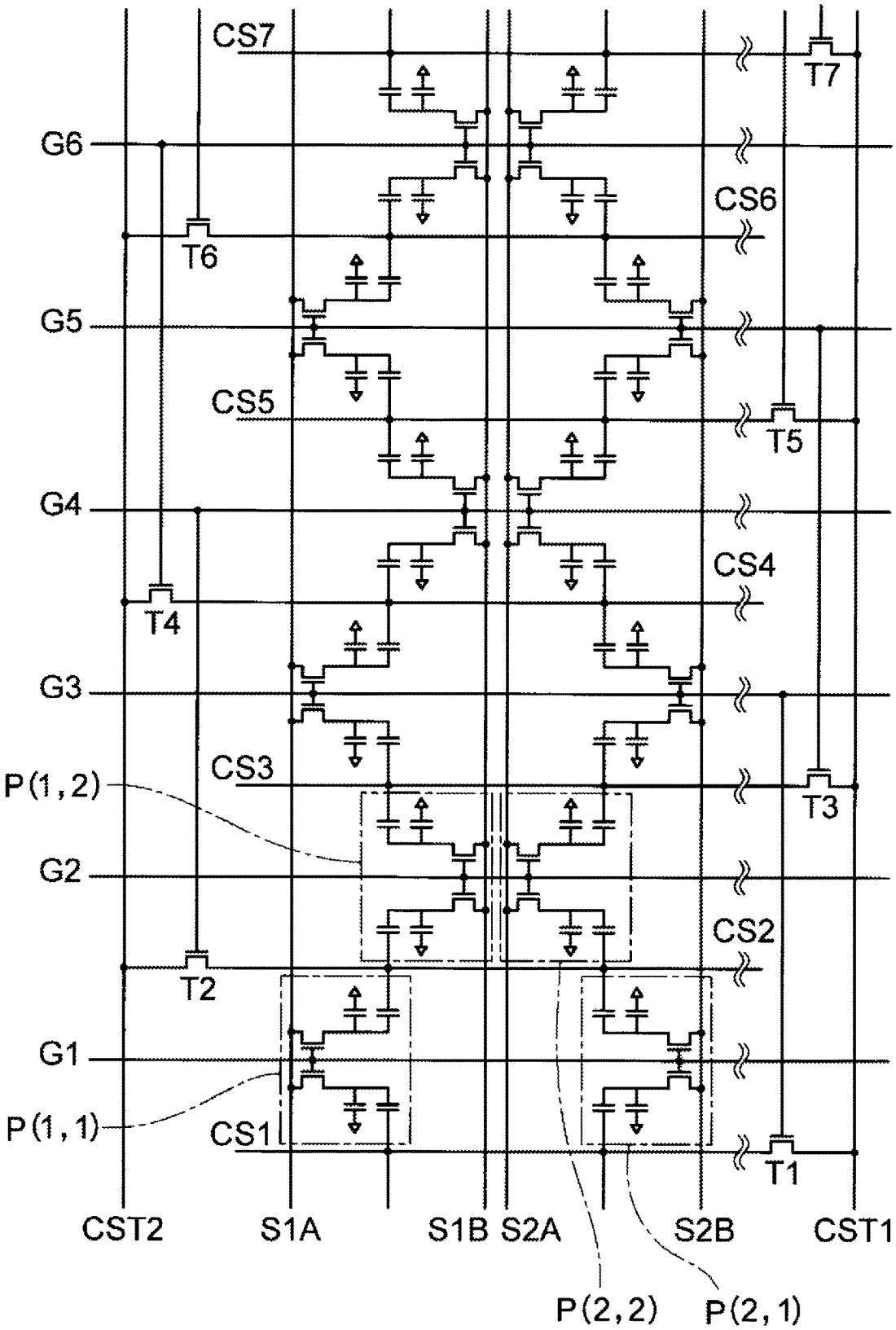
FIG. 2 schematically shows an equivalent circuit diagram of a region shown with A in FIG. 1A.

FIG. 2 is an equivalent circuit diagram schematically describing a region shown with A in FIG. 1A. The region A is a region comprising scanning lines G1 to G6 of the scanning lines G1 to GY. For convenience of explanations, only data lines S1 and S2 are shown with respect to the data lines S1 to SX. While each of auxiliary capacitance wirings CS1 to CSY+1 comprising the above-mentioned auxiliary capacitance wirings CS1, CS2 extends in the row direction and is actually arranged such that the auxiliary capacitance wirings being Y+1 in number are lined up in the column direction, in FIG. 2, seven auxiliary capacitance wirings CS1 to CS7 are shown. In the same manner as the scanning line Gn, CSn refers to the n-th auxiliary capacitance wiring in the column direction.

Pixel P (m, n) comprises the first sub-pixel P1 on one side sandwiching the scanning line Gn therebetween (below the scanning line Gn when viewed on paper in FIG. 2) and the second sub-pixel P2 on the other side sandwiching the scanning line Gn therebetween (above the scanning line Gn when viewed on paper in FIG. 2). An auxiliary capacitance wiring CSn+1 is provided between the scanning line Gn and a scanning line Gn+1. The auxiliary capacitance wiring CS1 is provided at a position opposing the auxiliary capacitance wiring CS2 across the scanning line G1 being positioned at the lowermost end in the column direction. Likewise, an auxiliary capacitance wiring CSY+1 (not shown) is provided at a position opposing an auxiliary capacitance wiring CSY (not shown) across a scanning line GY being positioned at the uppermost end in the column direction. The sub-pixels P1 comprised in each pixel P of the row pixel group P (1, n) to P (X, n) connected to the scanning line Gn are connected to the same auxiliary capacitance wiring (the auxiliary capacitance wiring CSn in FIG. 2), while the sub-pixels P2 comprised therein are connected to the same auxiliary capacitance wiring (the auxiliary capacitance wiring CSn+1 in FIG. 2).

Focusing on the extending direction of the data line Sm, in the pixel P (m, n), and a pixel P (m, n−1) neighboring below the pixel P (m, n), each of the first auxiliary capacitance P13 of the pixel P (m, n) and the second auxiliary capacitance P23 of the pixel P (m, n−1) is connected to the one auxiliary capacitance wiring CSn being provided between the first sub-pixel P1 of the pixel P (m, n) and the second sub-pixel P2 of the pixel P (m, n−1). Likewise, in the pixel P (m, n), and a pixel P (m, n+1) neighboring above the pixel P (m, n), each of the second auxiliary capacitance P23 of the pixel P (m, n) and the first auxiliary capacitance P13 of the pixel P (m, n+1) is connected to the auxiliary capacitance wiring CSn+1 being arranged between the second sub-pixel P2 of the pixel P (m, n) and the first sub-pixel P1 of the pixel P (m, n+1). In other words, between pixels neighboring in the column direction, a shared use is made of one auxiliary capacitance wiring being arranged therebetween, and a common potential is supplied between neighboring sub-pixels of pixels neighboring in the column direction. In this way, the number of auxiliary capacitance wirings decreases and a decrease in the aperture ratio in the display region is suppressed. With respect to the first sub-pixel P1 comprised in each pixel P of the row pixel group P (1, 1) to P (X, 1) being positioned at the lowermost end and the second sub-pixel P2 comprised in each pixel P of the row pixel group P (1, Y) to P (X, Y) being positioned at the uppermost end, there is no sub-pixel neighboring therewith in the column direction, so that no shared use is made of the auxiliary capacitance wirings CS1 and CSY+1.

As shown in FIG. 2, a plurality of switching elements T1, T2, . . . are arranged in non-display regions (frame edge portions of the liquid crystal display 1) at the exterior of the display region DA, the non-display regions being opposite ends of the glass substrate 11 in the row direction. The plurality of switching elements T1, T2, . . . being arranged in the non-display regions, not in the display region, cause a decrease in the aperture ratio to be suppressed. The auxiliary capacitance wiring CSn is connected to the drain electrode of the n-th switching element Tn. The source electrodes of the odd-numbered switching elements T1, T3, . . . are connected to the first auxiliary capacitance trunk wiring CST1, while the source electrodes of the even-numbered switching elements T2, T4, . . . are connected to the second auxiliary capacitance trunk wiring CST2. The odd-numbered auxiliary capacitance wirings CS1, CS3, . . . are selectively connected to the first auxiliary capacitance trunk line CST1 via the odd-numbered switching elements T1, T3, . . . respectively. The even-numbered auxiliary capacitance wirings CS2, CS4, . . . are selectively connected to the second auxiliary capacitance trunk line CST2 via the even-numbered switching elements T2, T4, . . . , respectively. The gate electrode of the switching element Tn, in a case of the first sub-pixel P1 connected to the above-mentioned switching element Tn as a reference, is connected to a scanning line Gn+2 being two rows following the scanning line Gn to which is supplied a scanning signal to select the pixels P (1, n) to P (X, n) comprising the above-mentioned first sub-pixel P1. On the other hand, the gate electrode of the switching element Tn, in a case of the second sub-pixel P2 being connected to the above-mentioned switching element Tn as a reference, is connected to a scanning line Gn+2 being three rows following the scanning line Gn−1 to which is supplied a scanning signal to select pixels P (1, n−1) to P (X, n−1) comprising the above-mentioned second sub-pixel P2. In order to supply the first potential or the second potential to a large number of sub-pixels P1, P2 comprised in each pixel P of the row pixel group, the switching elements T1, T2, . . . comprise TFTs each having a size greater than that of the switching elements P11, P21 comprised in the sub-pixels P1, P2.

In the present Embodiment, the data line Sm to supply one data signal comprises two data lines SmA and SmB in order to supply data signals having mutually different polarities. The row pixel groups P (1, 1) to P (X, 1), P (1, 3) to P (X, 3), . . . being connected to odd-numbered row scanning lines G1, G3, . . . are connected to the data line SmA, respectively, while the row pixel groups P (1, 2) to P (X, 2), P (1, 4) to P (X, 4), . . . being connected to even-numbered row scanning lines G2, G4, . . . are connected to the data line SmB, respectively. In this way, the liquid crystal display panel 10 can be driven using a so-called dot inversion scheme in which, in 1F, data signals having alternately different polarities are supplied in the arbitrary column pixel group P (m, 1) to P (m, Y) and data signals having alternately different polarities are supplied in the arbitrary row pixel group P (1, n) to P (X, n).

Method for Driving Liquid Crystal Display Apparatus According to Embodiment 1

Figure 3:
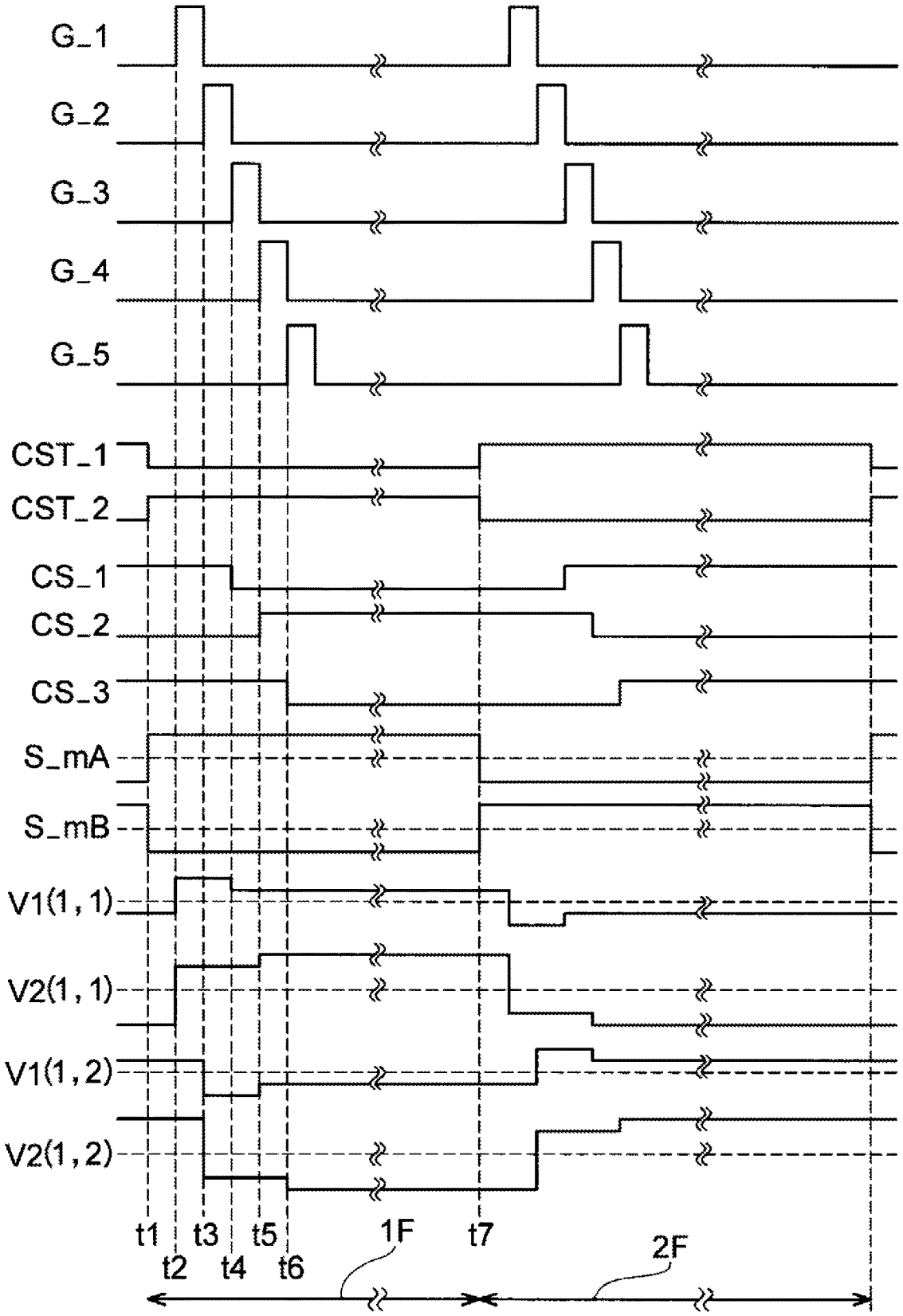
FIG. 3 shows a timing chart of signals to be supplied to a circuit shown in FIG. 2.

A method for driving the liquid crystal display apparatus 1 according to the present Embodiment being configured as described above is described below. FIG. 3 is a timing chart of signals to be supplied to a circuit shown in FIG. 2. For convenience of explanations, FIG. 3 envisages a case in which video data represents data to consecutively display solid images, so that, in 1F, data signals having the same potential are supplied to all of the pixels P of the liquid display panel 10. Moreover, in FIG. 3, a potential being high level of a first potential is the same as a potential being high level of a second potential, while a potential being low level of the first potential is the same as a potential being low level of the second potential. FIG. 3 shows the behavior of potentials of pixels P (1, 1) and P (1, 2) in such a case. Below, displaying of the liquid crystal display panel 10 is also described on the premise that the liquid crystal display panel 10 uses a normally black scheme.

A scanning signal to be supplied to the scanning line Gn is called a scanning signal G_n, while a data signal to be supplied to the data line SmA and a data signal to be supplied to the data line SmB are called S_mA and S_mB, respectively. Moreover, the first potential and the second potential to be supplied to the first auxiliary capacitance trunk wiring CST1 and the second auxiliary capacitance trunk wiring CST2 are called CST_1 and CST_2, respectively, while the potential to be supplied to the auxiliary capacitance wiring CSn is called CS_n. Moreover, the potential of the pixel electrode P121 in the first sub-pixel P1 of the pixel P (m, n) (the potential of the auxiliary capacitance electrode P131) is called V1 (m, n), while the potential of the pixel electrode P221 in the second sub-pixel P2 of the pixel P (m, n) (the potential of the auxiliary capacitance electrode P231) is called V2 (m, n).

First, in time t1, the data signal S_mA of positive polarity, the data signal S_mA corresponding to the first F of video data starts to be supplied to the data line SmA, while the data signal S_mB of negative polarity starts to be supplied to the data line SmB. Moreover, the first potential CST_1 to be supplied to the first auxiliary capacitance trunk wiring CST1 changes from high level to low level, while the second potential CST_2 to be supplied to the second auxiliary capacitance trunk wiring CST2 changes from low level to high level.

Next, in time t2, the pulse of the scanning signal G_1 is supplied to the first-row scanning line G1. In this way, the pulse of the scanning signal G_1 is supplied to the gate electrodes of the switching elements P11, P21 comprised in each pixel P of the first-row row pixel group P (1, 1) to P (X. 1), causing the above-mentioned switching elements P11, P21 to be turned on. Therefore, in the sub-pixels P1, P2 of the pixels P (1, 1), P (3, 1), . . . being connected to the data line SmA of each pixel P of the first-row row pixel group P (1, 1) to P (X. 1), the liquid crystal capacitances P12, P22 and the auxiliary capacitances P13, P23 are charged in accordance with the data signal S_mA. On the other hand, in the sub-pixels P1, P2 of the pixels P (2, 1), P (4, 1), being connected to the data line SmB of each pixel P of the first-row row pixel group P (1, 1) to P (X. 1), the liquid crystal capacitances P12, P22 and the auxiliary capacitances P13, P23 are charged in accordance with the data signal S_mB. As a result, the potentials V1 (1, 1), V1 (3, 1), . . . of the pixel electrodes P121 and the potentials V2 (1, 1), V2 (3, 1), . . . of the pixel electrodes P221 in the first-row pixels P (1, 1), P (3, 1) . . . being connected to the data line SmA change to the positive potentials, respectively (the potentials V1 (1, 1) and V2 (1, 1) shown in FIG. 3). On the other hand, the potentials V1 (2, 1), V1 (4, 1), . . . of the pixel electrodes P121 and the potentials V2 (2, 1), V2 (4, 1), . . . of the pixel electrodes P221 in the first-row pixels P (2, 1), P (4, 1) being connected to the data line SmB change to the negative potentials, respectively (not shown).

The pixel P (1, 1) is connected to a data line S1A, so that the potential V1 (1, 1) of the pixel electrode P121 in the first sub-pixel P1 thereof and the potential V2 (1, 1) of the pixel electrode P221 in the second sub-pixel P2 thereof take the positive potential being the same level. Therefore, at this time, the first sub-pixel P1 and the second sub-pixel P2 are visually recognized at the same luminance in the pixel P (1, 1).

Next, in time t3, the pulse of the scanning signal G_2 is supplied to the second row scanning line G2. In this way, the pulse of the scanning signal G_2 is supplied to the gate electrodes of the switching elements P11, P21 comprised in each pixel P of the second-row row pixel group P (1, 2) to P (X. 2), causing the above-mentioned switching elements P11, P21 to be turned on. Therefore, in the sub-pixels P1 and P2 of the pixels P (2, 2), P (4, 2), . . . being connected to the data line SmA of each pixel P of the second-row row pixel group P (1, 2) to P (X. 2), the liquid crystal capacitances P12, P22 and the auxiliary capacitances P13, P23 are charged in accordance with the data signal S_mA. On the other hand, in the sub-pixels P1 and P2 of the pixels P (1, 2), P (3, 2), . . . being connected to the data line SmB of each pixel P of the second-row row pixel group P (1, 2) to P (X, 2), the liquid crystal capacitances P12, P22 and the auxiliary capacitances P13, P23 are charged in accordance with the data signal S_mB. As a result, the potentials V1 (2, 2), V1 (4, 2), . . . of the pixel electrodes P121 and the potentials V2 (2, 2), V2 (4, 2), . . . of the pixel electrodes P221 in the second-row pixels P (2, 2), P (4, 2) being connected to the data line SmA change to the positive potentials, respectively (not shown). On the other hand, the potentials V1 (1, 2), V1 (3, 2), . . . of the pixel electrodes P121 and the potentials V2 (1, 2), V2 (3, 2), . . . of the pixel electrodes P221 in the second-row pixels P (1, 2), P (3, 2) being connected to the data line SmB and change to the negative potential, respectively (the potentials V1 (1, 2) and V2 (1, 2) shown in FIG. 3).

The pixel P (1, 2) is connected to a data line S1B, so that the potential V1 (1, 2) of the pixel electrode P121 in the first sub-pixel P1 thereof and the potential V2 (1, 2) of the pixel electrode P221 in the second sub-pixel P2 thereof take the negative potential being the same level. Therefore, at this time, the first sub-pixel P1 and the second sub-pixel P2 are visually recognized at the same luminance in the pixel P (1, 2).

Next, in time t4, the pulse of the scanning signal G_3 is supplied to the third row scanning line G3. In this way, the pulse of scanning signal G_3 is supplied to the third-row row pixel group P (1, 3) to P (X, 3) as well as to the switching element T1, causing the switching element T1 to be turned on. Therefore, the first potential CST_1 being low level is supplied from the first auxiliary capacitance trunk wiring CST1 to the auxiliary capacitance wiring CS1 (see CS_1 (the potential to be supplied to the auxiliary capacitance wiring CS1) in FIG. 3), causing electric charge of the first auxiliary capacitance P13 of each pixel P of the row pixel group P (1, 1) to P (X, 1) being connected to the auxiliary capacitance wiring CS1 to change in accordance with the first potential CST_1 being low level. In other words, the scanning signal G_3 serves a role of a first control signal to supply a first potential to a first auxiliary capacitance of a certain first sub-pixel (for example, the first sub-pixel P1 of the pixel P (1, 1)). In conjunction therewith, the electric charge is further charged in the first auxiliary capacitance P13 of each pixel P of the row pixel group P (1, 1) to P (X, 1).

Therefore, in conjunction with the above-described charging of each first auxiliary capacitance P13, each potential V1 (1, 1) to V1 (X, 1) of the pixel electrode P121 of the first sub-pixel P1 comprised in each pixel P of the row pixel group P (1, 1) to P (X, 1) takes a lower potential.

In the pixel P (1, 1), while the potential V1 (1, 1) of the pixel electrode P121 of the first sub-pixel P1 takes a lower potential, the potential V2 (1, 1) of the pixel electrode P221 of the second sub-pixel P2 is kept at the same positive potential, causing the first sub-pixel P1 to have the viewing angle property being different from that of the second sub-pixel P2. As a result, the first sub-pixel P1 is displayed at the luminance being lower than that of the second sub-pixel P2. Below, a case in which a certain sub-pixel is displayed darker than displaying at the luminance based on a data signal input to the pixel P comprising the above-mentioned sub-pixel is called "dark displaying". In a manner converse thereto, a case in which a certain sub-pixel is displayed lighter than displaying at the luminance based on a data signal input to the pixel P comprising the above-mentioned sub-pixel is called "light displaying". In this way, when the one sub-pixel P1 has the viewing angle property being different from that of the other sub-pixel P2 in each pixel P, mutually different viewing angle properties are combined, making it possible to improve the viewing angle dependency in the liquid crystal display apparatus 1.

Next, in time t5, the pulse of the scanning signal G_4 is supplied to the fourth row scanning line G4. In this way, the pulse of scanning signal G_4 is supplied to the fourth-row row pixel group P (1, 4) to P (X, 4) as well as to the switching element T2, causing the switching element T2 to be turned on. Therefore, the second potential CST_2 being high level is supplied from the second auxiliary capacitance trunk wiring CST2 to the auxiliary capacitance wiring CS2 (see CS_2 (the potential to be supplied to the auxiliary capacitance wiring CS2) in FIG. 3), causing the potential of the second auxiliary capacitance P23 of each pixel P of the row pixel group P (1, 1) to P (X, 1) and the first auxiliary capacitance P13 of each pixel P of the row pixel group P (1, 2) to P (X, 2) being connected to the capacitance wiring CS2 to change in accordance with the first potential CST_2 being high level. In other words, the scanning signal G_4 serves a role of a second control signal to supply a second potential to a second auxiliary capacitance of a certain second sub-pixel (for example, the second sub-pixel P2 of the pixel P (1, 1)) and serves a role of a third control signal to supply a second potential to a third auxiliary capacitance of a certain third sub-pixel (for example, the first sub-pixel P1 of the pixel P (1, 2)). In conjunction therewith, the stored electric charge is partially discharged in the second auxiliary capacitance P23 of each pixel P of the row pixel group P (1, 1) to P (X, 1). Likewise, the stored electric charge is partially discharged in the first auxiliary capacitance P13 of each pixel P of the row pixel group P (1, 2) to P (X, 2).

Therefore, in conjunction with the above-described discharging of each second auxiliary capacitance P23, each potential V2 (1, 1) to V2 (X, 1) of the pixel electrodes P221 of the second sub-pixels P2 comprised in each pixel P of the row pixel group P (1, 1) to P (X, 1) takes a higher potential. Likewise, in conjunction with the above-described discharging of each first auxiliary capacitance P13, each potential V1 (1, 2) to V1 (X, 2) of the pixel electrode P121 of the first sub-pixel P1 comprised in each pixel P of the row pixel group P (1, 2) to P (X, 2) takes a higher potential.

In the pixel P (1, 1), the potential V1 (1, 1) of the pixel electrode P121 of the first sub-pixel P1 is kept at the lower positive potential, so that the viewing angle property of the first sub-pixel P1 remains the same. On the other hand, the potential V2 (1, 1) of the pixel electrode P221 of the second sub-pixel P2 takes the higher positive potential, causing the second sub-pixel P2 to have the viewing angle property being different from that of the sub-pixel P1. As a result, the first sub-pixel P1 remains dark displaying, and the displaying of the second sub-pixel P2 exhibits light displaying.

Likewise, in the pixel P (1, 2), while the potential V1 (1, 2) of the pixel electrode P121 of the first sub-pixel P1 takes a higher negative potential, the potential V2 (1, 2) of the pixel electrode P221 of the second sub-pixel P2 is kept at the same negative potential, causing the first sub-pixel P1 to have the viewing angle property being different from that of the second sub-pixel P2. As a result, the displaying of the first sub-pixel P1 exhibits dark displaying.

Next, in time t6, the pulse of the scanning signal G_5 is supplied to the fifth-row scanning line G5. In this way, the pulse of the scanning signal G_5 being a fourth control signal is supplied to the fifth-row row pixel group P (1, 5) to P (X, 5) as well as to the switching element T3, causing the switching element T3 to be turned on. Therefore, the first potential CST_1 being low level is supplied from the first auxiliary capacitance trunk wiring CST1 to the auxiliary capacitance wiring CS3 (see CS_3 (the potential to be supplied to the auxiliary capacitance wiring CS3) in FIG. 3), causing the potential of the second auxiliary capacitance P23 of each pixel P of the row pixel group P (1, 2) to P (X, 2) and the first auxiliary capacitance P13 of each pixel P of the row pixel group P (1, 3) to P (X, 3) being connected to the capacitance wiring CS3 to change in accordance with the first potential CST_1 being low level. In other words, the scanning signal G_5 serves a role of a fourth control signal to supply a first potential to a fourth auxiliary capacitance of a certain fourth sub-pixel (for example, the second sub-pixel P2 of the pixel P (1, 2)). In conjunction therewith, the electric charge is further charged in the second auxiliary capacitance P23 of each pixel P of the row pixel group P (1, 2) to P (X, 2). Likewise, the electric charge is further charged in the first auxiliary capacitance P13 of each pixel P of the row pixel group P (1, 3) to P (X, 3).

Therefore, in conjunction with the above-described charging of each second auxiliary capacitance P23, each potential V2 (1, 2) to V2 (X, 2) of the pixel electrodes P221 of the second sub-pixels P2 comprised in each pixel P of the row pixel group P (1, 2) to P (X, 2) takes a lower potential. Likewise, in conjunction with the above-described charging of each first auxiliary capacitance P13, each potential V1 (1, 3) to V1 (X, 3) of the pixel electrodes P121 of the first sub-pixels P1 comprised in each pixel P of the row pixel group P (1, 3) to P (X, 3) takes a lower potential.

In the pixel P (1, 2), the potential V1 (1, 2) of the pixel electrode P121 of the first sub-pixel P1 is kept at the higher negative potential, so that the viewing angle property of the sub-pixel P1 remains the same. On the other hand, the potential V2 (1, 2) of the pixel electrode P221 of the second sub-pixel P2 takes the lower negative potential, causing the second sub-pixel P2 to have the viewing angle property being different from that of the sub-pixel P1. As a result, the displaying of the first sub-pixel P1 remains dark displaying, and the displaying of the second sub-pixel P2 exhibits light displaying.

Thereafter, the scanning signals to G_6 to G_Y are successively supplied to each of the sixth-row scanning line G6 to the uppermost-end Y-th row scanning line GY in the same manner. In conjunction therewith, in each of the row pixel group P (1, 6) to P (X, 6) being connected to the sixth row scanning line G6 to the row pixel group P (1, Y) to P (X, Y) being connected to the scanning line GY, each potential V1 (1, 6) to V1 (X, 6), . . . , each potential V1 (1, Y) to V1 (X, Y) of the pixel electrodes P121 of the first sub-pixel P1 being comprised in each pixel P and each potential V2 (1, 6) to V2 (X, 6), . . . , V2 (1, Y) to V2 (X, Y) of the pixel electrodes P221 of the second sub-pixel P2 being comprised in each pixel P change as described above.

In the example shown in FIG. 2, on/off of the switching element Tn to be connected to the auxiliary capacitance wiring CSn to which the first sub-pixel P1 of the pixel P (m, n) connects is controlled based on a scanning signal G_n+2 being two rows following the scanning signal G_n to select the pixel P (m, n). On the other hand, on/off of a switching element Tn+1 to be connected to the auxiliary capacitance wiring CSn+1 to which the second sub-pixel P2 of the pixel P (m, n) connects is controlled based on a scanning signal G_n+3 being three rows following the scanning signal G_n to select the pixel P (m, n). Therefore, in each of switching elements TY−1, TY, and TY+1 to be connected to auxiliary capacitance wirings CSY−1, CSY, and CSY+1 from the auxiliary capacitance wiring CSY−1 being two rows prior to the uppermost end auxiliary capacitance wiring CSY+1 to the uppermost end auxiliary capacitance wiring CSY+1, a scanning line for supplying a scanning signal to be controlled does not exist. Therefore, the liquid crystal display panel 10 comprises dummy scanning lines GY+1, GY+2, and GY+3 to supply scanning signals G_Y+1, G_Y+2, G_Y+3 to the switching elements TY−1, TY, TY+1, respectively. Each of the gate electrodes of the switching elements TY−1, TY, TY+1 is connected to the dummy scanning lines GY+1, GY+2, and GY+3.

In this way, the first potential CST_1 and the second potential CST_2 to be supplied to the pixel P (m, n) are controlled by the scanning signals G_n+2, G_n+3 to select a further following row pixel groups P (1, n+2) to P (X, n+2), P (1, n+3) to P (X, n+3). respectively. Therefore, even when using the first potential CST_1 and the second potential CST_2 whose level change in units of 1F, the first potential CST1 and the second potential CST_2 are supplied to the pixel P (m, n) at suitable timings on a regular basis.

Figure 4:
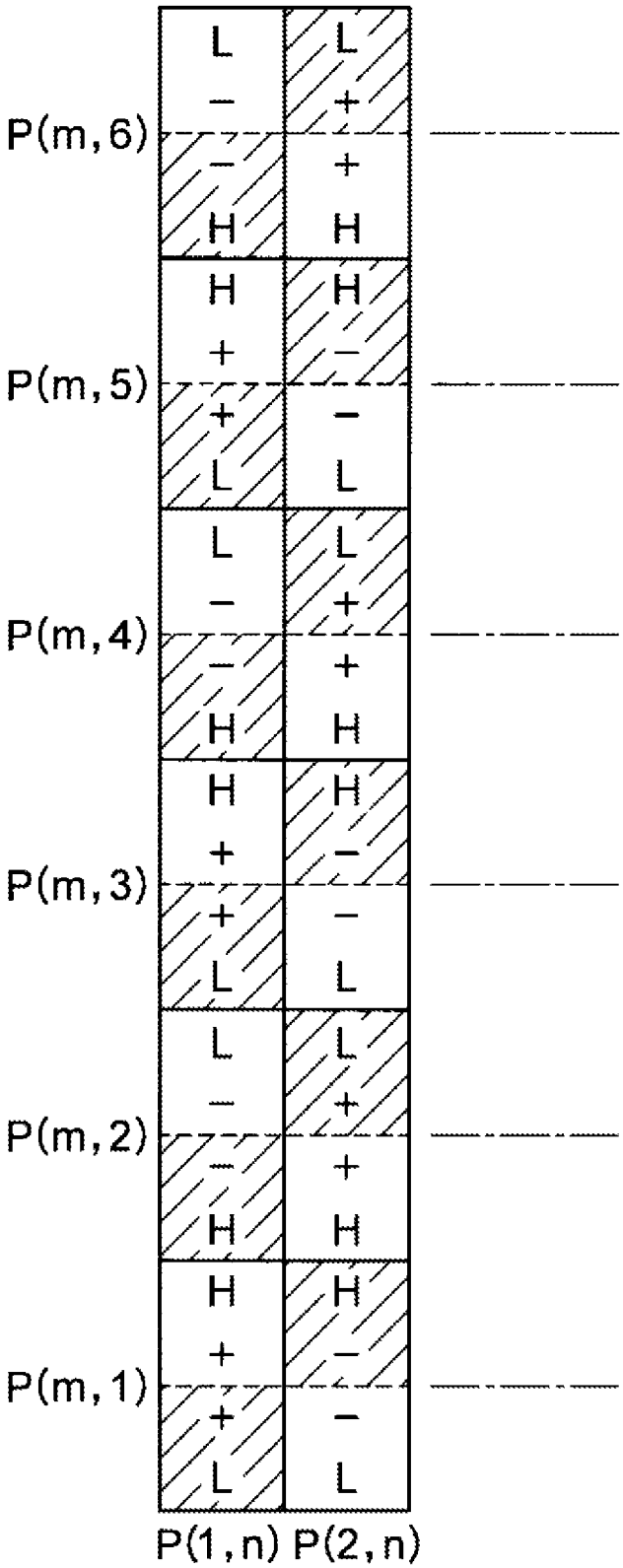
FIG. 4 shows an explanatory diagram of light and dark displaying of the liquid crystal display apparatus when the circuit shown in FIG. 2 is driven by the signals shown in FIG. 3.

FIG. 4 shows light and dark displaying in the first F of the above-described video data with respect to the sub-pixels P1 and P2 of each pixel P in FIG. 2. The solid-line frame shows one pixel P, while two cells (below and above as viewed on paper) in the solid-line frame show the sub-pixel P1 and the sub-pixel P2, respectively. "H" and "L" shown in the cells show whether the first potential CST_1 and the second potential CST_2 to be supplied, in the first F, from the auxiliary capacitance wiring CSn to the sub-pixels P1, P2 are high level or low level. "+" and "−" shown in the cells show whether the data signal SmA, SmB to be supplied, in the first F, from the data line SmA, SmB to the sub-pixel P1, P2 has the positive polarity or the negative polarity. The cell being hatched shows that displaying of the sub-pixel P1, P2 is dark displaying in the first 1F, while the cell not being hatched shows that displaying of the sub-pixel P1, P2 is light displaying in the first 1F. As shown in FIG. 4, in the drive scheme according to the present Embodiment, it is understood that a dot inversion drive scheme and driving of the auxiliary capacitance wiring using a scanning signal cause light and dark displaying of the plurality of pixels P being arranged in the matrix to have a checkerboard pattern in which, in an odd-numbered column, displaying of each first sub-pixel P1 is dark displaying and displaying of each second sub-pixel P2 is dark displaying, while, in an even-numbered column, displaying of each first sub-pixel P1 is light displaying and displaying of each second sub-pixel P2 is dark displaying.

Next, at time t7, the data signal S_mA of the negative polarity, the data signal S_mA corresponding to the second F of video data, and the data signal S_mB of the positive polarity start to be supplied to the data line SmA and the data line SmB, respectively. In addition, the first potential CST_1 supplied to the first auxiliary capacitance trunk wiring CST1 changes from low level to high level, while the second potential CST_2 supplied to the second auxiliary capacitance trunk wiring CST2 changes from high level to low level. In other words, in synchronization with the timing at which the polarities of the data signals supplied to the data line SmA, SmB reverses, respectively, whether levels are low level or high level of the first potential CST_1 and the second potential CST_2 being supplied to the auxiliary capacitance trunk wirings CST1, CST2 also reverses, respectively. Therefore, in the second F, the potential V1 (m, n) of the pixel electrode P121 of the first sub-pixel P1 in each pixel P (m, n) and the potential V2 (m, n) of the pixel electrode P221 of the second sub-pixel P2 in each pixel P (m, n) changes to the potential of the reversed polarities with the magnitudes thereof being the same as those of the potentials in the first F, respectively.

Therefore, also in the second F, as in the first F, it is understood that light and dark displaying of the plurality of the pixels P being arranged in the matrix has a checkerboard pattern in which, in the odd-numbered column, displaying of each first sub-pixel P1 is dark displaying and displaying of each second sub-pixel P2 is light displaying while, in the even-numbered column, displaying of each first sub-pixel P1 is light displaying and displaying of each second sub-pixel P2 is dark displaying. Then, in an odd-numbered frame, the potential V1 (m, n), V2 (m, n) changes with time in the same manner as in the first F, while, in an even-numbered frame, the potential V1 (m, n), V2 (m, n) changes with time in the same manner as in the second F. In this way, light and dark displaying in each sub-pixel P1, P2 does not change in any frame period, making it possible to avoid a so-called flickering phenomenon.

In the liquid crystal display apparatus 1 according the present Embodiment configured in this way, each of the plurality of pixels P being arranged in the matrix comprises the first sub-pixel P1 and the second sub-pixel P2, and the liquid crystal display apparatus 1 comprises the first auxiliary capacitance trunk wiring CST1 to which the first potential CST_1 is supplied and the second auxiliary capacitance trunk wiring CST2 to which the second potential CST_2 is supplied. Then, one of the first potential CST_1 and the second potential CST_2 is supplied to the first auxiliary capacitance P13 of the first sub-pixel P1 comprised in the arbitrary pixel P (m, n) based on the scanning signal (the first control signal) G_n+2 being two rows after the pixel P (m, n). On the other hand, the other of the first potential CST_1 and the second potential CST_2 is supplied to the second auxiliary capacitance P23 of the second sub-pixel P2 comprised in the pixel P (m, n) based on the scanning signal (the second control signal) G_n+3 being three rows after the pixel P (m, n). Therefore, adopting the first potential CST_1 and second potential CST_2 having a relatively long period, in which first potential CST_1 and second potential CST_2 high level and low level switches for each 1F and not adopting a short-period oscillatory potential or a large number of oscillatory potentials having mutually different phases makes it possible to supply the first potential CST_1 and the second potential CST_2 at timings optimal for the first auxiliary capacitance P13 and the second auxiliary capacitance P23 of the pixel P (m, n) based on the scanning signal signals G_n+2, G_n+3 to select a further following row.

When one of the first potential CST_1 and the second potential CST_2 (for example, the first potential CST_1) is supplied to the first auxiliary capacitance 13 of the pixel P (m, n), the potential of the pixel electrode P121 of the first sub-pixel P1 takes a potential different from the potential per se (for example, a potential lower than the potential per se) being caused by the data signal SmA, SmB, causing the potential of the pixel electrode P121 of the first sub-pixel P1 to be a potential being different from the potential of the pixel electrode P221 of the second sub-pixel P2. Therefore, the sub-pixel P1 and the sub-pixel P2 are to have mutually different viewing angle properties. Thereafter, when the other of the first potential CST_1 and the second potential CST_2 (for example, the second potential CST_2) is supplied to the second auxiliary capacitance 13 of the pixel (m, n), the potential of the pixel electrode P221 of the second sub-pixel P2 takes a potential different from the potential per se being caused by the data signals SmA, SmB (for example, a potential higher than the potential per se), causing the potential of the pixel electrode P221 of the second sub-pixel P2 to be a potential being further different from the potential the pixel electrode P121 of the first sub-pixel P1. Therefore, the first sub-pixel P1 and the second sub-pixel P2 are to have further mutually different viewing angle properties. This makes it possible to improve the viewing angle dependency in the liquid crystal display apparatus 1 as the whole.

In the present Embodiment, the first potential CST_1 and the second CST_2 having relatively long periods are adopted, making it more difficult to be impacted by rounding of the waveform of the first potential and the second potential. This makes it possible to suppress rounding of amounts of electric charges stored in the first auxiliary capacitance P13 and the second auxiliary capacitance P23 to which the first potential CST_1 and the second potential CST_2 are supplied, respectively, and rounding of the waveforms of the potentials V1 (m, n) and V2 (m, n) of the pixel electrodes P121 and P221 being tied to these electric charge amounts, respectively. Therefore, luminance errors in the first sub-pixel P1 and the second sub-pixel P2 are prevented, causing the display definition of the liquid crystal display apparatus 1 to be improved.

Moreover, in the present Embodiment, there is no need to provide a large number of oscillatory potentials, making it possible to reduce the number of auxiliary capacitance trunk wirings to supply them. Therefore, the width of the frame edge to house the auxiliary capacitance trunk wiring can be reduced.

Moreover, the auxiliary capacitance wiring CSn is provided between the pixel P (m, n), and the pixel P (m, n−1) neighboring in the column direction, and either one of the first potential CST_1 and the second potential CST_2 is supplied from one auxiliary capacitance wiring CSn to the first auxiliary capacitance P13 in the first sub-pixel P1 of the pixel P (m, n) and the second auxiliary capacitance P23 in the second sub-pixel P2 of the pixel P (m, n−1). In this way, wirings to prevent transmission of light from the backlight are reduced, making it possible to suppress a decrease in the aperture ratio in the display region DA.

Embodiment 2

Next, the liquid crystal display apparatus according to Embodiment 2 of the present disclosure will be explained. The liquid crystal display apparatus according to Embodiment 2 is different from the liquid crystal display apparatus according to Embodiment 1 with respect to arrangement of switching elements, auxiliary capacitance wirings, data lines, and data signals to be supplied. Therefore, the differing portions will be explained below.

Configuration of Liquid Crystal Display Apparatus According to Embodiment 2

Figure 5:
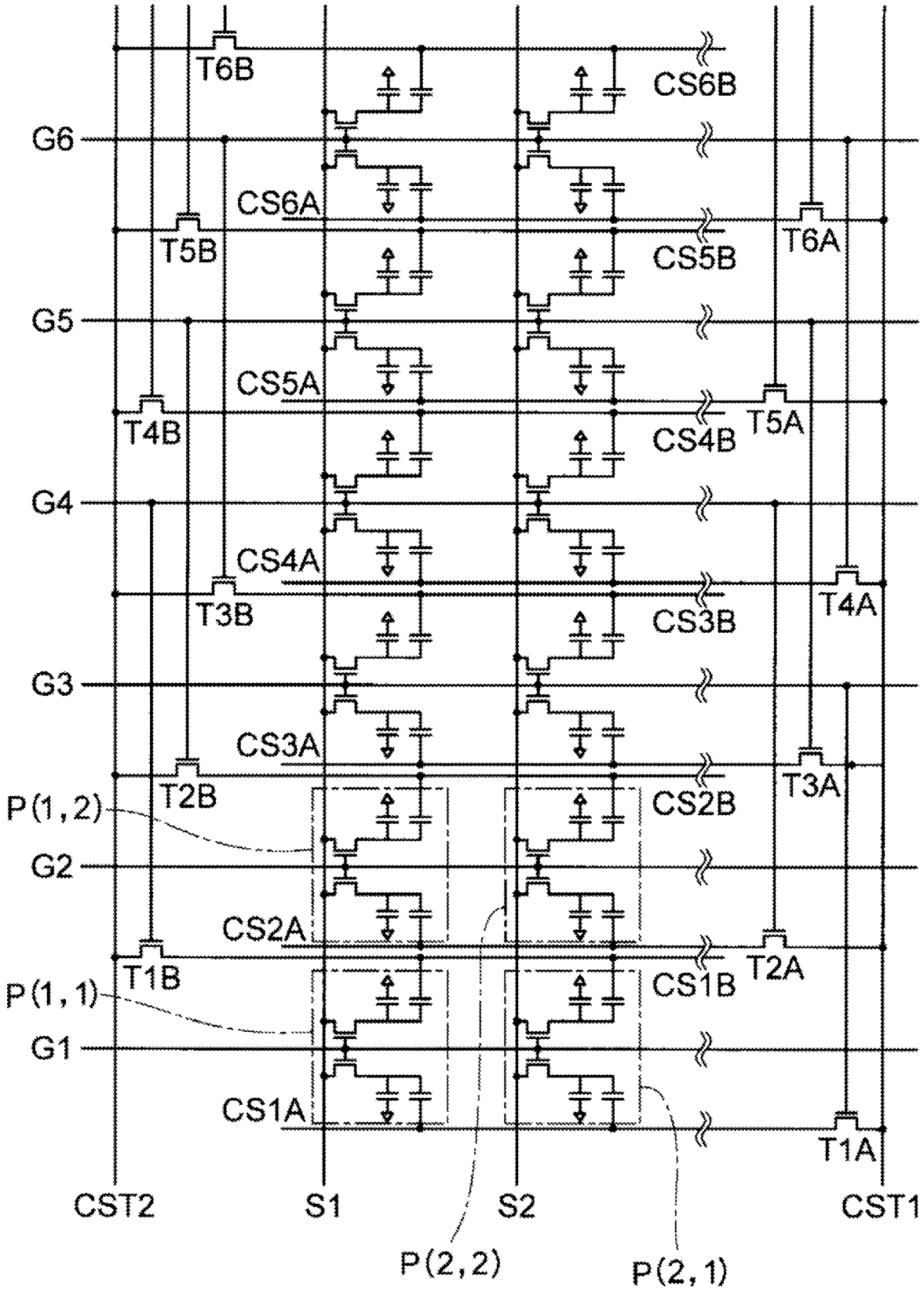
FIG. 5 schematically shows an equivalent circuit diagram of a region corresponding to the region shown with A in FIG. 1A in the liquid crystal display apparatus according to Embodiment 2.

FIG. 5 is an equivalent circuit diagram to explain the liquid crystal display apparatus according to Embodiment 2 of the present disclosure, the equivalent circuit diagram showing the region shown with A in FIG. 1A as in FIG. 2. In the present Embodiment, a pixel P (m, n) comprises two sub-pixels being a first sub-pixel P1 and a second sub-pixel P2 in the same manner as in the example shown in FIG. 1B. A first auxiliary capacitance P13 of the pixel P (m, n) and a second auxiliary capacitance P23 of the pixel P (m, n−1) are connected to different auxiliary capacitance wirings CSnA and CSn-1B, respectively. Switching elements TnA and TnB are provided in correspondence with auxiliary capacitance wirings CSnA and CSnB, respectively. The drain electrode of the switching element TnA is connected to the auxiliary capacitance wiring CSnA, while the drain electrode of the switching element TnB is connected to the auxiliary capacitance wiring CSnB. The source electrode of the switching element TnA is connected to a first auxiliary capacitance trunk wiring CST1, while the source electrode of the switching element TnB is connected to a second auxiliary capacitance trunk wiring CST2. The same as in Embodiment 1 is in that the gate electrode of the switching element TnA to connect to the first auxiliary capacitance P13 is connected to a scanning line Gn+2 being two rows following a scanning line Gn to which is supplied a scanning signal G_n to select the pixel P (m, n), and the gate electrode of the switching element TnB to connect to the second auxiliary capacitance P23 is connected to a scanning line Gn+3 being three rows following the scanning line Gn to which is supplied the scanning signal G_n to select the pixel P (m, n).

In the present Embodiment, a data line Sm to one column pixel group P (m, 1) to P (m, Y) is made up of one data line Sm unlike Embodiment 1 in which it is made up of two data lines SmA, SmB. In the same manner as in Embodiment 1, a data signal S_m to be supplied to the data line Sm is a signal using the inversion scheme in which the potential changes between the positive polarity and the negative polarity for each 1F. Therefore, the liquid crystal display panel 10 can be driven using a so-called column inversion scheme in which data signals having alternately different polarities are supplied to the column pixel group P (m, 1) to P (m, Y) in one frame period.

In the liquid crystal display apparatus 1 according to the present Embodiment, the polarity of the data signal S_m to be supplied is the same in one-column column pixel group P (m, 1) to P (m, Y), in order to be driven using the column inversion scheme. In this case, in the same manner as in Embodiment 1, sharing one auxiliary capacitance wiring CSm between pixels P (m, n) and P (m, n−1) neighboring in the column direction would cause displaying of two sub-pixels neighboring in the column direction across the auxiliary capacitance wiring CSm to match as either one of light displaying and dark displaying. In other words, in this case, a sub-pixel in light displaying and a sub-pixel in dark displaying would not be alternately arranged. The sub-pixel in light displaying and the sub-pixel in dark displaying being not alternately arranged would be possible to cause flickering of the displaying to occur.

Thus, in the present Embodiment, two independent auxiliary capacitance wirings CSnA, CSn-1B are provided with the auxiliary capacitance wiring CSm not being shared between the pixel P (m, n) and the pixel P (m, n−1) neighboring in the column direction. In this way, mutually different potentials (a first potential CST_1 and a second potential CST_2) are supplied to the auxiliary capacitance P13 and the auxiliary capacitance P23 of an arbitrary pixel P (m, n) and, in the pixel P (m, n) and the pixel P (m, n−1) mutually neighboring in the column direction, the mutually different potentials (the first potential CST_1 and the second potential CST_2) can also be supplied to the first sub-pixel P1 of the pixel P (m, n) and the second sub-pixel P2 of the pixel P (m, n−1) neighboring in sub-pixel units.

Method for Driving Liquid Crystal Display Apparatus According to Embodiment 2

Figure 6:
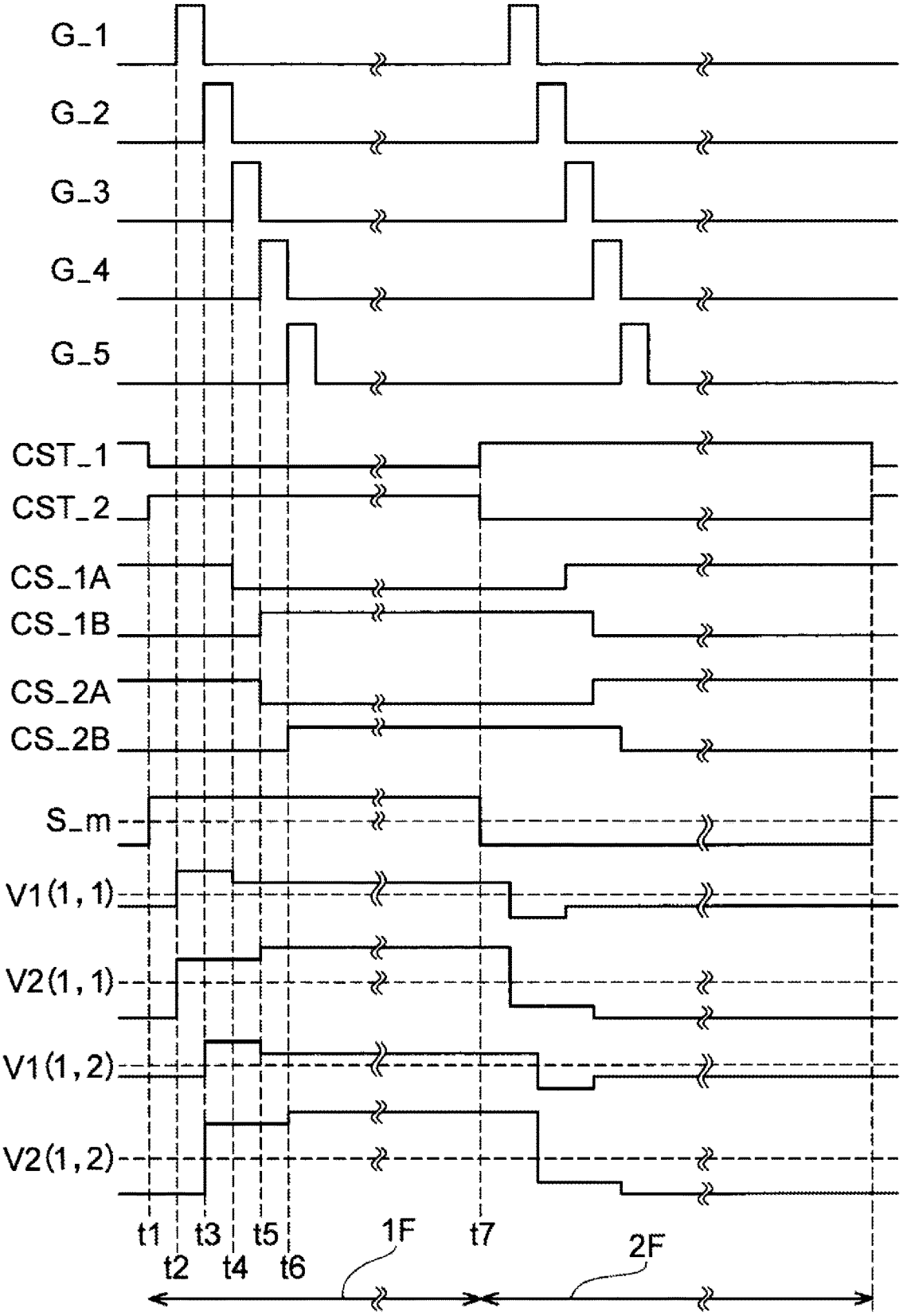
FIG. 6 shows a timing chart of signals to be supplied to a circuit shown in FIG. 5.

FIG. 6 is a timing chart of signals to be supplied to a circuit shown in FIG. 5. In the same manner as FIG. 3, FIG. 6 shows the behavior of the potential of pixels P (1, 1) and P (1, 2), and so on, in a case that video data represents data to consecutively display solid images and, in one frame period, data signals having the same potential are supplied to all of the pixels P of the liquid display panel 10. Moreover, FIG. 7, in the same manner as FIG. 4, shows light and dark displaying of video data in the first F with respect to the sub-pixels P1 and P2 of each pixel P shown in FIG. 5.

Focusing on the m-th column, column pixel group P (m, 1) to P (m, Y), while, in Embodiment 1 using the dot inversion scheme, the data signals S_mA and S_mB to be supplied have polarities reversed in pixel units, in the present Embodiment using a column inversion scheme, the data signals S_m to be supplied have the same polarity. Moreover, in the present Embodiment, as described above, the mutually different first potential CST_1 and second potential CST_2 are supplied to the auxiliary capacitance wirings CSnA, CSn-1B. Moreover, in an arbitrary pixel P (m, n), in the same manner as in Embodiment 1, the auxiliary capacitance wiring CSnA being connected to the first auxiliary capacitance P13 is controlled based on a scanning signal G_n+2 being two rows following (a first control signal), while the auxiliary capacitance wiring CSnB being connected to the second auxiliary capacitance P23 is controlled based on a scanning signal G_n+3 being three rows following (a second control signal).

Figure 7:
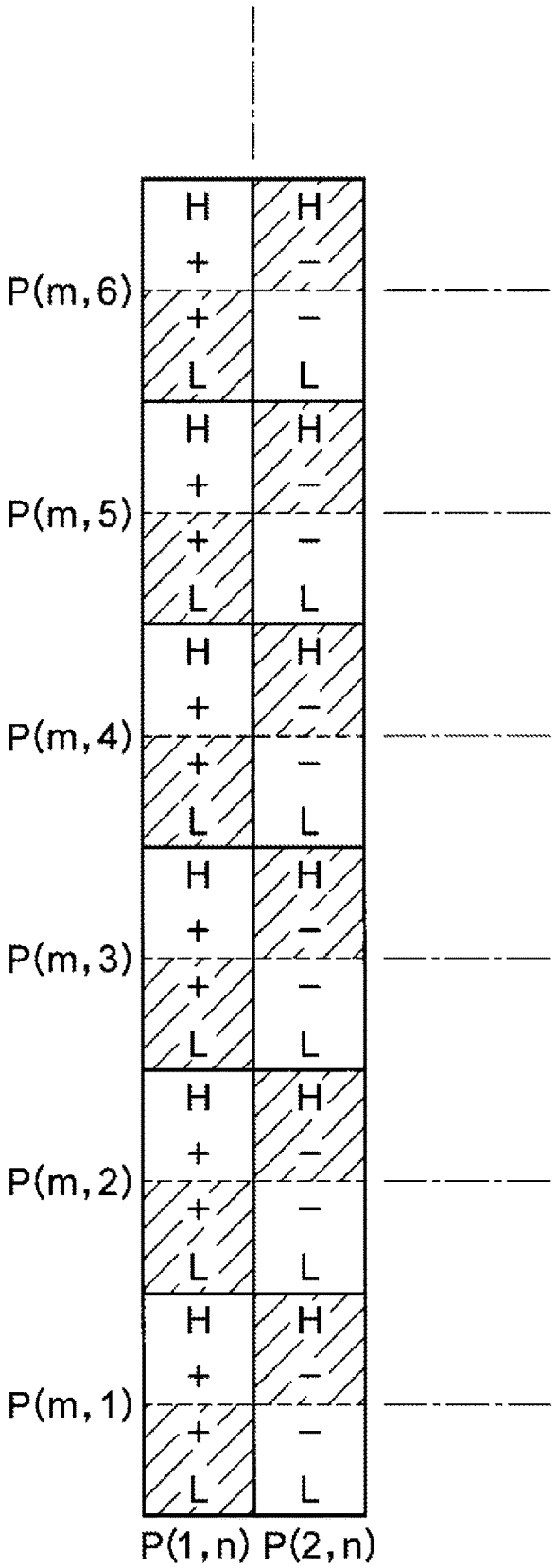
FIG. 7 shows an explanatory diagram of light and dark displaying of the liquid crystal display apparatus when the circuit shown in FIG. 5 is driven by the signals shown in FIG. 6.

Therefore, in the present embodiment, with respect to the potentials being the potential V1 (m, n) of the first pixel electrode P121 and the potential V2 (m, n) of the second pixel electrode P221, the potentials being the potential V1 (m, n) of the first pixel electrode P121 and the potential V2 (m, n) of the second pixel electrode P221 in the even-numbered row pixels P have reverse polarities to the potential V1 (m, n) and the potential V2 (m, n) in Embodiment 1. Except for the above, the potentials being the potential V1 (m, n) and the potential V2 (m, n) in the present Embodiment are the same as the potential V1 (m, n) and the potential V2 (m, n) in Embodiment 1 in the first F including time t1 to time t6, the second F and thereafter. Therefore, as shown in FIG. 7, it is understood that the driving method according to the present Embodiment, in the same manner as Embodiment 1, in any frame period, causes light and dark displaying of the plurality of the pixels P being arranged in the matrix to be in a checkerboard pattern in which, in the odd-numbered column, displaying of the first sub-pixel P1 is dark displaying and displaying of the second sub-pixel P2 is light displaying, while, in the even-numbered column, displaying of the first sub-pixel P1 is light displaying and displaying of the second sub-pixel P2 is dark displaying.

The liquid display apparatus 1 of Embodiment 2 configured in this way makes it possible to yield the same advantageous effects as those of Embodiment 1 even when the column inversion drive scheme is adopted while the dot inversion drive scheme is not adopted. In addition, adopting the column inversion drive scheme causes the number of data signals required for video displaying to be reduced. Therefore, consumed power of the liquid crystal display apparatus 1 can be reduced. In the present Embodiment, while the number of auxiliary capacitance wirings provided between mutually neighboring pixels P (m, n) and P (m, n−1) increases, the number of data lines Sm decreases by adopting the column inversion drive scheme, making it possible to suppress a decrease in the aperture ratio in the display region to the same extent as Embodiment 1.

Embodiment 3

Next, the liquid crystal display apparatus according to Embodiment 3 of the present disclosure is explained. The liquid crystal display apparatus according to Embodiment 3 differs from the liquid crystal display apparatus according to Embodiment 2 in the arrangement of the auxiliary capacitance wirings and the switching elements to be connected thereto. Therefore, the differing portions will be explained below.

Configuration of Liquid Crystal Display Apparatus According to Embodiment 3

Figure 8:
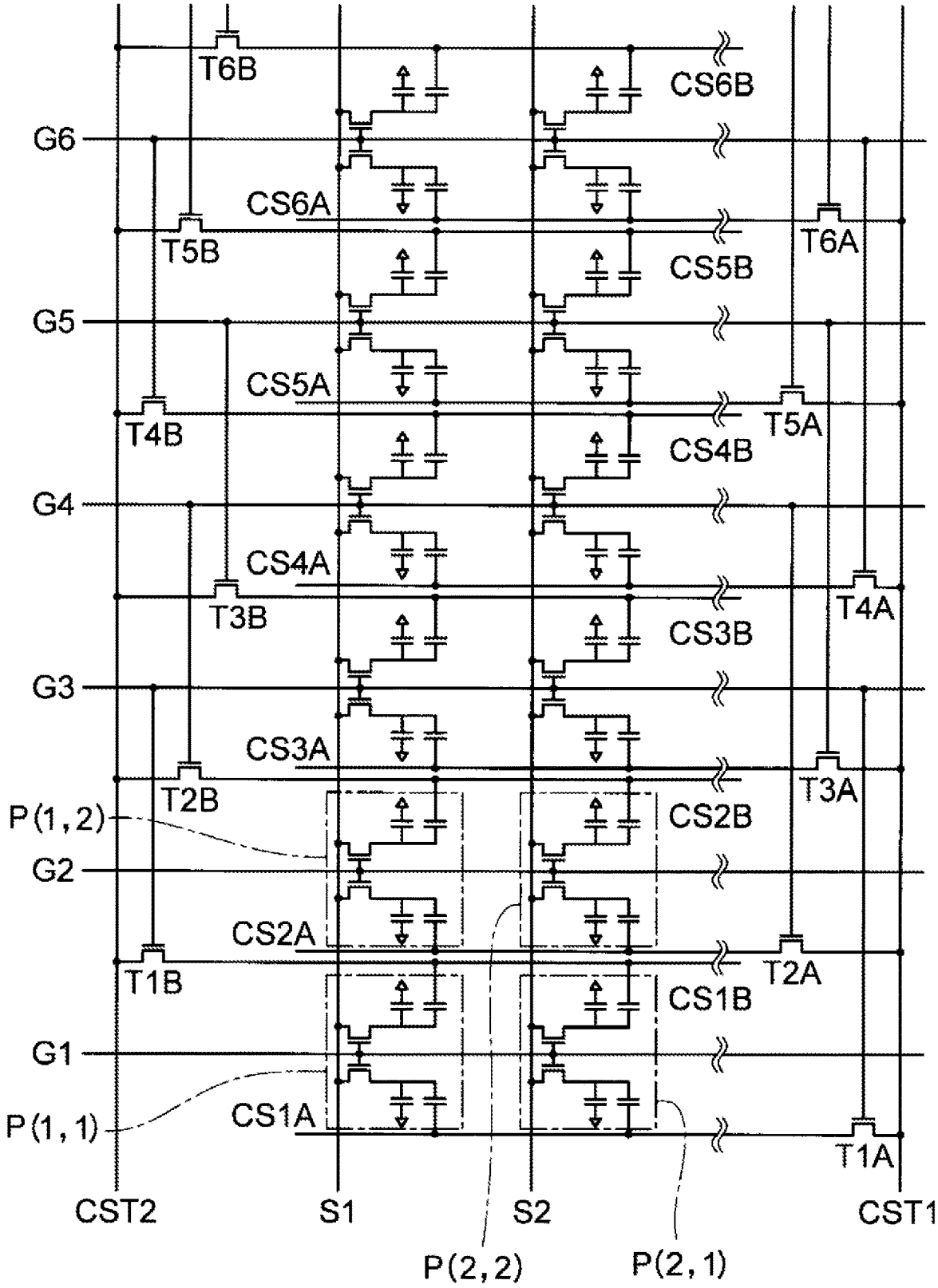
FIG. 8 schematically shows an equivalent circuit diagram of a region corresponding to the region shown with A in FIG. 1A in the liquid crystal display apparatus according to Embodiment 3.

FIG. 8 shows an equivalent circuit diagram to explain the display apparatus according to Embodiment 3 of the present disclosure. In the same manner as in FIG. 2 and FIG. 5, the region shown with A in FIG. 1 is shown. In the present Embodiment, the difference from Embodiment 2 is in that agate electrode of a switching element TnB in which the drain electrode is connected to an auxiliary capacitance wiring CSnB is connected to a scanning line Gn+2 being two rows following a scanning line Gn to which is supplied a scanning signal G_n to select a pixel P (m, n) in the same manner as a gate electrode of a switching element TnA. In other words, the difference from Embodiment 2 is in that in a certain one pixel P (m, n), an auxiliary capacitance wiring CSnA connected to a first auxiliary capacitance P13 and an auxiliary capacitance wiring CSnB connected to a second auxiliary capacitance P23 are controlled based on the same scanning signal G_n+2 being two rows following.

In addition, in the present Embodiment, a data line Sm to a certain one column pixel group P (m, 1) to P (m, Y) is made up of one data line Sm. A data signal S_m being supplied to the data line Sm is a signal using an inversion scheme in which the potential changes between the positive polarity and the negative polarity for each 1F in the same manner as in Embodiment 1 and Embodiment 2. Therefore, the liquid crystal display panel 10 can be driven using the column inversion scheme in the same manner as in Embodiment 2.

Method for Driving Liquid Crystal Display Apparatus According to Embodiment 3

Figure 9:
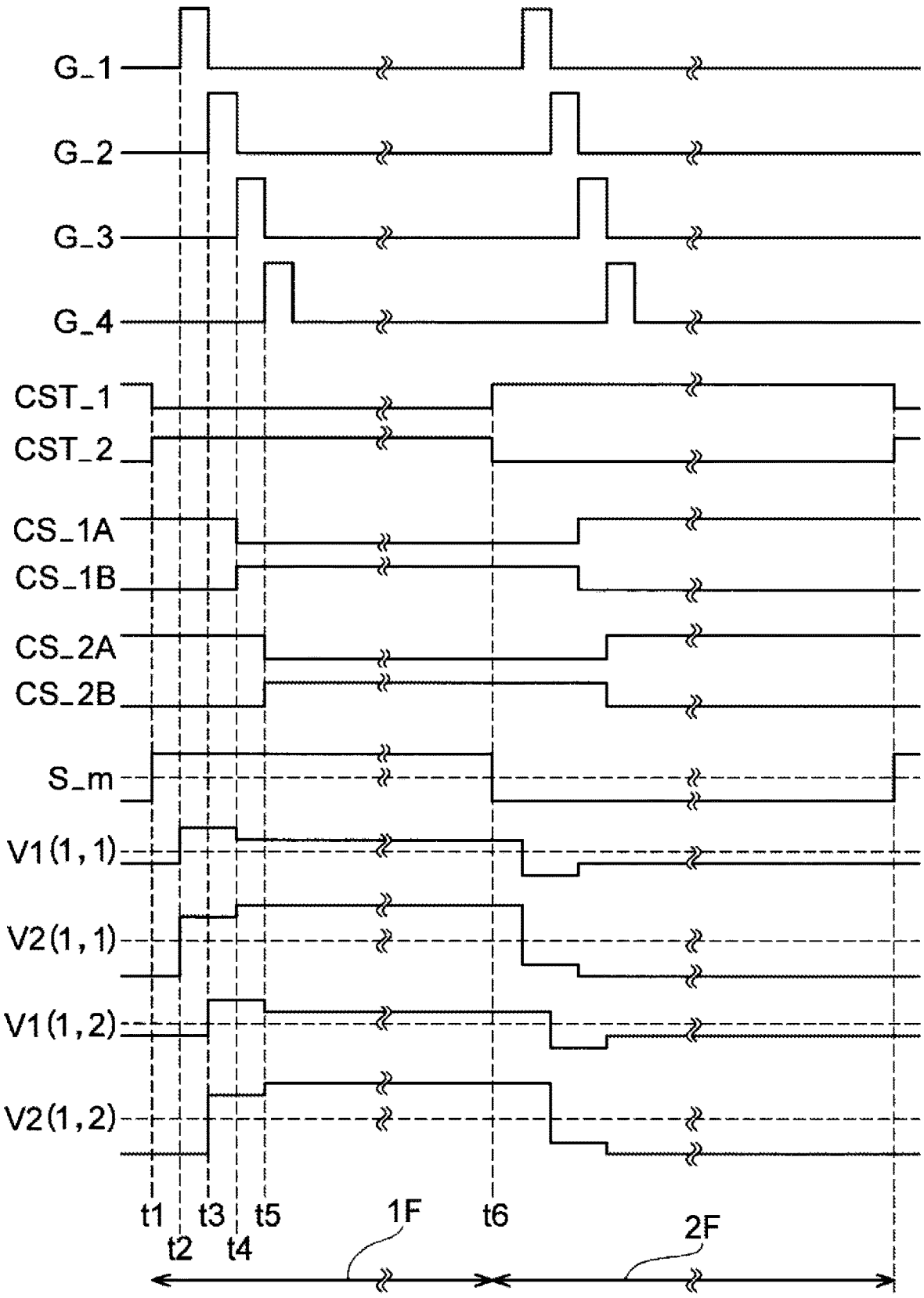
FIG. 9 shows a timing chart of signals to be supplied to a circuit shown in FIG. 8.

FIG. 9 is a timing chart of signals to be supplied to a circuit shown in FIG. 8. In the same manner as FIG. 3 and FIG. 6, FIG. 9 shows the behavior of the potentials of pixels P (1, 1) and P (1, 2) in a case that video data represents data to consecutively display solid images and, in one frame period, data signals having the same potential are supplied to all of the pixels P of the liquid display panel 10.

As described above, the scanning signal (a second signal) G_n+2 being two rows after the scanning signal G_n to select the pixel P (m, n), or, in other words, the scanning signal being one row previous to a scanning line Gn+3 in Embodiment 2 is supplied to the gate electrode of the switching element TnB in the present Embodiment. Therefore, the turning at which the second potential CST_2 is supplied to the auxiliary capacitance wiring CSnB (time t4 with respect to V2 (1, 1), time t5 with respect to V2 (1, 2) in FIG. 9) is to be earlier than the timing in Embodiment 2 (time t5 with respect to V2 (1, 1), time t6 with respect to V2 (1, 2) in FIG. 6). Moreover, as described above, in the present Embodiment, the gate electrode of the switching element TnB is connected to the scanning signal (a first control signal) G_n+2 being two rows after the scanning signal G_n to select the pixel P (m, n) in the same manner as the gate electrode of the switching element TnA.

Therefore, the timing at which the second potential CST_2 is supplied to the auxiliary capacitance wiring CSnB (time t4 with respect to V2 (1, 1), time t5 with respect to V2 (2, 1)) is to be the same as the timing at which the first potential CST_1 is supplied to the auxiliary capacitance wiring CSnA (time t4 with respect to V2 (1, 1), time t5 with respect to V2 (2, 1)). The present embodiment differs from Embodiment 2 in the above-mentioned points, so it is understood that, in any frame period, light and dark displaying of the plurality of the pixels P arranged in the matrix is to be a checkerboard pattern in which, in the odd-numbered column, displaying of each first sub-pixel P1 is dark displaying and displaying of each second sub-pixel P2 is light displaying, while, in the even-numbered column, displaying of each first sub-pixel P1 is light displaying and displaying of each second sub-pixel P2 is dark displaying.

The liquid crystal display apparatus 1 according to Embodiment 3 being configured in this way makes it possible to yield the same advantageous effects as those of Embodiment 2. In addition, the timing of light displaying of the second sub-pixel P2 in the certain one pixel P (m, n) is brought forward relative to Embodiment 2, causing it to be the same as the timing of light displaying of the first sub-pixel P1. Therefore, with respect to the first sub-pixel P1 and the second sub-pixel P2, the period in which the viewing angle properties differ gets longer. This makes it possible to further enhance the effect of improving the viewing angle dependency in the liquid crystal display apparatus 1.

The Other Embodiments

In the above-described Embodiments, each of the pixels P being arranged in a matrix comprises the first sub-pixel P1 and the second sub-pixel P2. However, the present disclosure is construed to be not limited thereto. For example, each of the pixels P can comprise a plurality of sub-pixels, the plurality being the number exceeding two. In this case, the charging/discharging of the auxiliary capacitance and the potential of the pixel electrode can be controlled at each of the plurality of sub-pixels to increase the number of sub-pixels having different viewing angle properties in the one pixel P. Therefore, auxiliary capacitance trunk wirings to supply mutually different potentials can be provided in a plurality, the plurality being the number of sub-pixels provided.

In the above-described Embodiments, the auxiliary capacitance trunk wirings CST1, CTS2 are provided in a plurality, the plurality being the number of sub-pixels comprised in one pixel P in order to supply mutually different potentials to the two sub-pixels P1 and P2 being comprised in one pixel P. However, the present disclosure is construed to be not limited thereto. For example, a plurality of auxiliary capacitance trunk wirings can be provided, the plurality being the number exceeding one sharing the same potential with respect to each sub-pixel in order to further prevent rounding of the waveform due to the resistance of wiring.

In the above-described Embodiments, each of switching elements Tn, TnA, and TnB is connected to either one of the scanning line Gn+2 being two rows following and the scanning line Gn+3 being three rows following the scanning line Gn to which is supplied the scanning signal G_n to select the pixel P (m, n). However, the present disclosure is construed to be not limited thereto. For example, each of the switching elements Tn, TnA, and TnB can be connected to scanning lines Gn+4 to GY being four or more rows following the scanning line Gn to which is supplied the scanning signal to select the pixel P (m, n). The switching elements P11 and P12 in the pixel P (m, n) are not turned off until after supplying of the pulse of the scanning signal G_n to select the pixel P (m, n) has been completed, so that no potential difference occurs between the potential V1 (m, n) of the first liquid crystal electrode P12 and the potential V2 (m, n) of the second liquid crystal electrode P22. Conversely thereto, selecting a scanning line being too following the scanning line Gn shortens the period of light and dark displaying of the first sub-pixel P1 and the second sub-pixel P2, making it difficult to obtain the effect of improving the viewing angle dependency in the liquid crystal display apparatus 1. Therefore, in a case that a scanning signal uses a single pulse scheme, for example, the switching elements Tn, TnA, and TnB are preferably connected to the scanning line Gn+2 being two rows following or the scanning line Gn+3 being three rows following the scanning line Gn to which is supplied the scanning signal G_n to select the pixel P (m, n).

In the above-described Embodiments, the first auxiliary capacitance trunk wiring CST1 and the second auxiliary capacitance trunk wiring CST2 are respectively provided at opposite ends in the row direction of a glass substrate 11. However, the present disclosure is not to be limited thereto. For example, all of the auxiliary capacitance trunk wirings can be provided at only one end in the row direction of the glass substrate 11, for example.

In the above-described Embodiments, the scanning line drive unit 20, the data line drive unit 30, and the auxiliary capacitance line drive unit 40 are mounted at the exterior of the glass substrate 11 as components being different from the glass substrate 11. However, the present disclosure is construed to be not limited thereto. For example, any one of the scanning line drive unit 20, the data line drive unit 30, and the auxiliary capacitance line drive unit 40 can be formed on the glass substrate 11. Moreover, the auxiliary capacitance line drive unit 40 can be provided integrally with the data line drive unit 30, and/or the like.

In the above-described Embodiments, the liquid crystal display panel 10 is driven using the dot inversion drive scheme or the column inversion drive scheme. However, the present disclosure is construed to be not limited thereto. For example, in one frame period, a liquid crystal display panel being driven using a so-called row inversion drive scheme in which data signals having alternately different polarities are supplied to each of a plurality of row pixel groups P (1, n) to P (x, n) in one frame period, for example.

While Embodiments of the present disclosure have been described in the above, the present disclosure is construed to be not limited to the above-described. Embodiments, so that a variety of variations can be carried out within the scope without departing from the gist of the present disclosure. Moreover, it is to be noted that the above-described Embodiments are not construed to limit the invention claimed herein.

Summary

A liquid crystal display apparatus according to aspect 1 of the present disclosure comprises: a plurality of pixels arranged in a matrix; a plurality of scanning lines, each of the plurality of scanning lines being connected to a row pixel group arranged in the row direction of the plurality of pixels, in which plurality of scanning lines is successively supplied a scanning signal to select the row pixel group; and a plurality of data lines, each of the plurality of data lines being connected to a column pixel group arranged in the column direction of the plurality of pixels, to which plurality of data lines is supplied a data signal to supply, to the column pixel group, a potential based on video data, wherein a first pixel of the plurality of pixels comprises a first sub-pixel and a second sub-pixel; the first sub-pixel and the second sub-pixel are connected to a first scanning line of the plurality of scanning res, to which first scanning line is supplied a first scanning signal; the first sub-pixel comprises a first liquid crystal capacitance and a first auxiliary capacitance, the first liquid crystal capacitance to be selectively connected to a first data line of the plurality of data lines based on the first scanning signal and the first auxiliary capacitance being connected to the first liquid crystal capacitance, and a first potential is supplied to the first auxiliary capacitance based on a first control signal being a scanning signal to select any one of the plurality of row pixel groups after the first scanning signal; and the second sub-pixel comprises a second liquid crystal capacitance and a second auxiliary capacitance, the second liquid crystal capacitance to be selectively connected to the first data line based on the first scanning signal and the second auxiliary capacitance being connected to the second liquid crystal capacitance; and a second potential being different from the first potential is supplied to the second auxiliary capacitance based on a second control signal being a scanning signal to select any of the row pixel group after the first scanning signal.

The configuration according to aspect 1 of the present disclosure makes it possible to supply the first potential and the second potential being mutually different to the first auxiliary capacitance and the second auxiliary capacitance, respectively, at optimal timings based on the first control signal and the second control signal to select any one of the row pixel groups after the first scanning signal. Consequently, the potentials of the first liquid crystal capacitance and the second liquid crystal capacitance connected to the first auxiliary capacitance and the second auxiliary capacitance, respectively, also change at optimal timings. Therefore, the first sub-pixel P1 and the second sub-pixel being comprised in the same pixel (first pixel) come to have different viewing angle properties at optimal timings, so that the viewing angle dependency of pixels P is improved and, in turn, the viewing angle dependency of the liquid crystal display apparatus is improved.

A liquid crystal display apparatus according to aspect 2 further comprises, in aspect 1, a first auxiliary capacitance trunk wiring to supply the first potential and a second auxiliary capacitance trunk wiring to supply the second potential, wherein the first auxiliary capacitance is selectively connected to the first auxiliary capacitance trunk wiring; the second auxiliary capacitance is selectively connected to the second auxiliary capacitance trunk wiring; the first potential is supplied from the first auxiliary capacitance trunk wiring to the first auxiliary capacitance based on the first control signal; and the second potential is supplied from the second auxiliary capacitance trunk wiring to the second auxiliary capacitance based on the second control signal.

The configuration according to aspect 2 of the present disclosure allows using the first auxiliary capacitance trunk wiring to easily and conveniently supply a first potential to a first auxiliary capacitance. Moreover, a second auxiliary capacitance trunk wiring can be used to easily and conveniently supply the second potential to the second auxiliary capacitance.

In a liquid crystal display apparatus according to aspect 3, in aspect 2, the first auxiliary capacitance is connected to the first auxiliary capacitance trunk wiring via a first switching element to be controlled by the first control signal; and the second auxiliary capacitance is connected to the second auxiliary capacitance trunk wiring via a second switching element to be controlled by the second control signal.

The configuration according to aspect 3 of the present disclosure allows easily and conveniently connecting the first auxiliary capacitance to the first auxiliary capacitance trunk wiring via the first switching element to be controlled by the first control signal. Moreover, the second auxiliary capacitance can be easily and conveniently connected to the second auxiliary capacitance trunk wiring via the second switching element to be controlled by the second control signal.

In the display apparatus according to aspect 4, in aspect 3, the first auxiliary capacitance trunk wiring and the second auxiliary capacitance trunk wiring, and the first switching element and the second switching element are provided in non-display regions at the exterior of a display region configured by the plurality of pixels.

According to the configuration according to aspect 4 of the present disclosure, the first auxiliary capacitance trunk wiring and the second auxiliary capacitance trunk wiring, and the first switching element and the second switching element are provided in non-display regions, not in the display region, allowing a decrease in the aperture ratio to be suppressed.

In the display apparatus according to aspect 5, in any one of aspects 1 to 4, the first potential changes between a first level and a second level for each one frame period, the second level being a potential higher than the first level; the second potential changes between a third level and a fourth level for each one frame period, the fourth level being a potential higher than the third level; and the second potential takes the fourth level in a period in which the first potential takes the first level, and the second potential takes the third level in a period in which the first potential takes the second level.

According to the configuration according to aspect 5 of the present disclosure, the period of level change of the first potential and a second potential is a relatively long period, making it possible to suppress rounding of the waveform of the first potential and the second potential. This makes it possible to suppress the amount of electric charges stored in the first auxiliary capacitance and the second auxiliary capacitance to which the first potential and the second potential are supplied, and rounding of the waveform in the potential of the first liquid crystal capacitance and the second liquid crystal capacitance being tied to the above-mentioned amount of electric charges. Therefore, luminance errors in the first sub-pixel and the second sub-pixel are prevented, so that the display definition of the liquid crystal display apparatus is improved.

In the display apparatus according to aspect 6, in aspect 5, the data signal is a signal whose potential changes between the positive polarity and the negative polarity for each one frame period; in a frame period in which the data signal of positive polarity is supplied, the first level is supplied to the first auxiliary capacitance after supplying of the first scanning signal, and, in a frame period in which the data signal of negative polarity is supplied, the second level is supplied to the first auxiliary capacitance after supplying of the first scanning signal; and in the frame period in which the data signal of positive polarity is supplied, the fourth level is supplied to the second auxiliary capacitance after supplying of the first scanning signal, and, in the frame period in which the data signal of negative polarity is supplied, the third level is supplied to the second auxiliary capacitance after supplying of the first scanning signal.

According to the configuration according to aspect 6 of the present disclosure, in the first sub-pixel, the first level being the low level is supplied in the case that the data signal of positive polarity is supplied, while the second level being the high level is supplied in the case that the data signal of negative polarity is supplied. Therefore, dark displaying is carried out regardless of the data signal being positive or negative. On the other hand, in the second sub-pixel, the fourth level being the high level is supplied in the case that the data signal of positive polarity is supplied, while the third level being the low level is supplied in the case that the data signal of negative polarity is supplied. Therefore, light displaying is carried out regardless of the data signal being positive or negative. In other words, displaying of light or dark does not change in the first sub-pixel and the second sub-pixel, so that a so-called flickering phenomenon is avoided.

In the display apparatus according to aspect 7, in aspect 5 or 6, the third level is a potential being the same as a potential being the first level; and the fourth level is a potential being the same as a potential being the second level.

According to the configuration according to aspect 7 of the present disclosure, the potential being the first level and the third level and the potential being the second level and the fourth level can be shared.

In the display apparatus according to aspect 8, in one of aspects 1 to 7, the second pixel neighboring the first pixel in the column direction comprises a third sub-pixel and a fourth sub-pixel; the third sub-pixel neighbors the second sub-pixel in the column direction; the third sub-pixel and the fourth sub-pixel are connected to a second scanning line of the plurality of scanning lines, to which second scanning line is supplied a second scanning signal; the third sub-pixel comprises a third liquid crystal capacitance and a third auxiliary capacitance, the third liquid crystal capacitance to be selectively connected to the first data line based on the second scanning signal and the third auxiliary capacitance being connected to the third liquid crystal capacitance, and one of the first potential and the second potential is supplied to the third auxiliary capacitance based on a third control signal being a scanning signal to select any one of the plurality of row pixel groups after the second scanning signal; and the fourth sub-pixel comprises a fourth liquid crystal capacitance and a fourth auxiliary capacitance, the fourth liquid crystal capacitance to be selectively connected to the first data line based on the second scanning signal and the fourth auxiliary capacitance being connected to the fourth liquid crystal capacitance, and the other of the first potential and the second potential is supplied to the fourth auxiliary capacitance based on a fourth control signal being a scanning signal to select any one of the plurality of row pixel group after the second scanning signal.

According to the configuration according to aspect 8 of the present disclosure, the third sub-pixel is darkly displayed, while the fourth sub-pixel is lightly displayed, so that the viewing angle dependency is improved in the second pixel. Moreover, in the second sub-pixel and the third sub-pixel neighboring each other with the first pixel and the second pixel therebetween, the third sub-pixel is darkly displayed, while the second sub-pixel is lightly displayed, so that the viewing angle dependency is also improved between the neighboring sub-pixels. In this way, the viewing angle dependency of the liquid crystal display apparatus is further improved.

In the display apparatus according to aspect 9, in aspect 8, the second potential is supplied to the third auxiliary capacitance; the third control signal is the second control signal; and the second potential is supplied to the second auxiliary capacitance and the third auxiliary capacitance based on the second control signal from one wiring provided between the second sub-pixel and the third sub-pixel.

According to the configuration according to aspect 9 of the present disclosure, the one wiring is shared between the second sub-pixel of the first pixel and the third sub-pixel of the second pixel neighboring each other to supply the second potential to the second auxiliary capacitance and the third auxiliary capacitance, making it possible to reduce the number of wirings. In this way, a decrease in the aperture ratio in the display region of the liquid crystal display apparatus is suppressed.

In the display apparatus according to aspect 10 of the present disclosure, in any of aspects 1 to 9, the polarity of the data signal to be supplied to the first pixel is different from the polarity of both the data signal to be supplied to a pixel neighboring the first pixel in the row direction and the data signal to be supplied to the second pixel.

According to the configuration according to aspect 10 of the present disclosure, the present disclosure can be applied in a case that the liquid crystal display apparatus uses a so-called dot inversion drive scheme.

In the display apparatus according to aspect 11 of the present disclosure, in any of aspects 1 to 9, the polarity of the data signal to be supplied to the first pixel is different from the polarity of either one of the data signal to be supplied to a pixel neighboring the first pixel in the row direction and the data signal to be supplied to the second pixel.

According to the configuration according to aspect 11 of the present disclosure, the present disclosure can be applied in a case that the liquid crystal display apparatus uses a so-called column inversion drive scheme or row inversion drive scheme.

In the display apparatus according to aspect 12 of the present disclosure, in any of aspects 1 to 11, the first control signal and the second control signal are the same scanning signal.

According to the configuration according to aspect 12 of the present disclosure, the first control signal and the second control signal are the same scanning signal, so that electric charges stored in the first auxiliary capacitance and the second auxiliary capacitance, and the potential of the first liquid crystal capacitance and the second liquid crystal capacitance being connected to each of these change at the same timing. Therefore, the period in which the first sub-pixel and the second sub-pixel have different viewing angle properties can be longer, so that the viewing angle dependency of the liquid crystal display apparatus is improved.

What is claimed is:

1. A liquid crystal display apparatus comprising:

a plurality of pixels arranged in a matrix;

a plurality of scanning lines, each of the plurality of scanning lines being connected to a row pixel group arranged in the row direction of the plurality of pixels, to which plurality of scanning lines is successively supplied a scanning signal to select the row pixel group; and a plurality of data lines, each of the plurality of data lines being connected to a column pixel group arranged in the column direction of the plurality of pixels, to which plurality of data lines is supplied a data signal to supply, to the column pixel group, a potential based on video data, wherein a first pixel of the plurality of pixels comprises a first sub-pixel and a second sub-pixel;

the first sub-pixel and the second sub-pixel are connected to a first scanning line of the plurality of scanning lines, to which first scanning line is supplied a first scanning signal;

the first sub-pixel comprises a first liquid crystal capacitance and a first auxiliary capacitance, the first liquid crystal capacitance to be selectively connected to a first data line of the plurality of data lines based on the first scanning signal and the first auxiliary capacitance being connected to the first liquid crystal capacitance, and a first potential is supplied to the first auxiliary capacitance based on a first control signal being a scanning signal to select any one of the plurality of row pixel groups after the first scanning signal; and the second sub-pixel comprises a second liquid crystal capacitance and a second auxiliary capacitance, the second liquid crystal capacitance to be selectively connected to the first data line based on the first scanning signal and the second auxiliary capacitance being connected to the second liquid crystal capacitance, and a second potential being different from the first potential is supplied to the second auxiliary capacitance based on a second control signal being a scanning signal to select any one of the plurality of row pixel groups after the first scanning signal;

wherein a second pixel neighboring the first pixel in the column direction comprises a third sub-pixel and a fourth sub-pixel;

the third sub-pixel neighbors the second sub-pixel in the column direction;

the third sub-pixel and the fourth sub-pixel are connected to a second scanning line of the plurality of scanning lines, to which second scanning line is supplied a second scanning signal;

the third sub-pixel comprises a third liquid crystal capacitance and a third auxiliary capacitance, the third liquid crystal capacitance to be selectively connected to the first data line based on the second scanning signal and the third auxiliary capacitance being connected to the third liquid crystal capacitance, and one of the first potential and the second potential is supplied to the third auxiliary capacitance based on a third control signal being a scanning signal to select any one of the plurality of row pixel groups after the second scanning signal; and the fourth sub-pixel comprises a fourth liquid crystal capacitance and a fourth auxiliary capacitance, the fourth liquid crystal capacitance to be selectively connected to the first data line based on the second scanning signal and the fourth auxiliary capacitance being connected to the fourth liquid crystal capacitance, and the other of the first potential and the second potential is supplied to the fourth auxiliary capacitance based on a fourth control signal being a scanning signal to select any one of the plurality of row pixel groups after the second scanning signal; and wherein the polarity of the data signal to be supplied to the first pixel is different from the polarity of both the data signal to be supplied to a pixel neighboring the first pixel in the row direction and the data signal to be supplied to the second pixel.

2. The liquid crystal display apparatus according to claim 1, further comprising a first auxiliary capacitance trunk wiring to supply the first potential and a second auxiliary capacitance trunk wiring to supply the second potential, wherein the first auxiliary capacitance is selectively connected to the first auxiliary capacitance trunk wiring;

the second auxiliary capacitance is selectively connected to the second auxiliary capacitance trunk wiring;

the first potential is supplied from the first auxiliary capacitance trunk wiring to the first auxiliary capacitance based on the first control signal; and the second potential is supplied from the second auxiliary capacitance trunk wiring to the second auxiliary capacitance based on the second control signal.

3. The liquid crystal display apparatus according to claim 2, wherein the first auxiliary capacitance is connected to the first auxiliary capacitance trunk wiring via a first switching element to be controlled by the first control signal; and the second auxiliary capacitance is connected to the second auxiliary capacitance trunk wiring via a second switching element to be controlled by the second control signal.

4. The liquid crystal display apparatus according to claim 3, wherein the first auxiliary capacitance trunk wiring and the second auxiliary capacitance trunk wiring, and the first switching element and the second switching element are provided in non-display regions at the exterior of a display region configured by the plurality of pixels.

5. The liquid crystal display apparatus according to claim 1, wherein the first potential changes between a first level and a second level for each one frame period, the second level being a potential higher than the first level;

the second potential changes between a third level and a fourth level for each one frame period, the fourth level being a potential higher than the third level; and the second potential takes the fourth level in a period in which the first potential takes the first level, and the second potential takes the third level in a period in which the first potential takes the second level.

6. The liquid crystal display apparatus according to claim 5, wherein the data signal is a signal whose potential changes between the positive polarity and the negative polarity for each one frame period;

in a frame period in which the data signal of positive polarity is supplied, the first level is supplied to the first auxiliary capacitance after supplying of the first scanning signal, and, in a frame period in which the data signal of negative polarity is supplied, the second level is supplied to the first auxiliary capacitance after supplying of the first scanning signal; and in the frame period in which the data signal of positive polarity is supplied, the fourth level is supplied to the second auxiliary capacitance after supplying of the first scanning signal, and, in the frame period in which the data signal of negative polarity is supplied, the third level is supplied to the second auxiliary capacitance after supplying of the first scanning signal.

7. The liquid crystal display apparatus according to claim 5, wherein the third level is a potential being the same as a potential being the first level; and the fourth level is a potential being the same as a potential being the second level.

8. The liquid crystal display apparatus according to claim 1, wherein the first control signal and the second control signal are the same scanning signal.

9. A liquid crystal display apparatus comprising:

a plurality of pixels arranged in a matrix;

a plurality of scanning lines, each of the plurality of scanning lines being connected to a row pixel group arranged in the row direction of the plurality of pixels, to which plurality of scanning lines is successively supplied a scanning signal to select the row pixel group; and a plurality of data lines, each of the plurality of data lines being connected to a column pixel group arranged in the column direction of the plurality of pixels, to which plurality of data lines is supplied a data signal to supply, to the column pixel group, a potential based on video data, wherein a first pixel of the plurality of pixels comprises a first sub-pixel and a second sub-pixel;

the first sub-pixel and the second sub-pixel are connected to a first scanning line of the plurality of scanning lines, to which first scanning line is supplied a first scanning signal;

the first sub-pixel comprises a first liquid crystal capacitance and a first auxiliary capacitance, the first liquid crystal capacitance to be selectively connected to a first data line of the plurality of data lines based on the first scanning signal and the first auxiliary capacitance being connected to the first liquid crystal capacitance, and a first potential is supplied to the first auxiliary capacitance based on a first control signal being a scanning signal to select any one of the plurality of row pixel groups after the first scanning signal; and the second sub-pixel comprises a second liquid crystal capacitance and a second auxiliary capacitance, the second liquid crystal capacitance to be selectively connected to the first data line based on the first scanning signal and the second auxiliary capacitance being connected to the second liquid crystal capacitance, and a second potential being different from the first potential is supplied to the second auxiliary capacitance based on a second control signal being a scanning signal to select any one of the plurality of row pixel groups after the first scanning signal;

wherein a second pixel neighboring the first pixel in the column direction comprises a third sub-pixel and a fourth sub-pixel;

the third sub-pixel neighbors the second sub-pixel in the column direction;

the third sub-pixel and the fourth sub-pixel are connected to a second scanning line of the plurality of scanning lines, to which second scanning line is supplied a second scanning signal;

the third sub-pixel comprises a third liquid crystal capacitance and a third auxiliary capacitance, the third liquid crystal capacitance to be selectively connected to the first data line based on the second scanning signal and the third auxiliary capacitance being connected to the third liquid crystal capacitance, and one of the first potential and the second potential is supplied to the third auxiliary capacitance based on a third control signal being a scanning signal to select any one of the plurality of row pixel groups after the second scanning signal; and the fourth sub-pixel comprises a fourth liquid crystal capacitance and a fourth auxiliary capacitance, the fourth liquid crystal capacitance to be selectively connected to the first data line based on the second scanning signal and the fourth auxiliary capacitance being connected to the fourth liquid crystal capacitance, and the other of the first potential and the second potential is supplied to the fourth auxiliary capacitance based on a fourth control signal being a scanning signal to select any one of the plurality of row pixel groups after the second scanning signal; and wherein the polarity of the data signal to be supplied to the first pixel is different from the polarity of either one of the data signal to be supplied to a pixel neighboring the first pixel in the row direction and the data signal to be supplied to the second pixel.

10. The liquid crystal display apparatus according to claim 9, further comprising a first auxiliary capacitance trunk wiring to supply the first potential and a second auxiliary capacitance trunk wiring to supply the second potential, wherein the first auxiliary capacitance is selectively connected to the first auxiliary capacitance trunk wiring;

the second auxiliary capacitance is selectively connected to the second auxiliary capacitance trunk wiring;

the first potential is supplied from the first auxiliary capacitance trunk wiring to the first auxiliary capacitance based on the first control signal; and the second potential is supplied from the second auxiliary capacitance trunk wiring to the second auxiliary capacitance based on the second control signal.

11. The liquid crystal display apparatus according to claim 10, wherein the first auxiliary capacitance is connected to the first auxiliary capacitance trunk wiring via a first switching element to be controlled by the first control signal; and the second auxiliary capacitance is connected to the second auxiliary capacitance trunk wiring via a second switching element to be controlled by the second control signal.

12. The liquid crystal display apparatus according to claim 11, wherein the first auxiliary capacitance trunk wiring and the second auxiliary capacitance trunk wiring, and the first switching element and the second switching element are provided in non-display regions at the exterior of a display region configured by the plurality of pixels.

13. The liquid crystal display apparatus according to claim 9, wherein the first potential changes between a first level and a second level for each one frame period, the second level being a potential higher than the first level;

the second potential changes between a third level and a fourth level for each one frame period, the fourth level being a potential higher than the third level; and the second potential takes the fourth level in a period in which the first potential takes the first level, and the second potential takes the third level in a period in which the first potential takes the second level.

14. The liquid crystal display apparatus according to claim 13, wherein the data signal is a signal whose potential changes between the positive polarity and the negative polarity for each one frame period;

in a frame period in which the data signal of positive polarity is supplied, the first level is supplied to the first auxiliary capacitance after supplying of the first scanning signal, and, in a frame period in which the data signal of negative polarity is supplied, the second level is supplied to the first auxiliary capacitance after supplying of the first scanning signal; and in the frame period in which the data signal of positive polarity is supplied, the fourth level is supplied to the second auxiliary capacitance after supplying of the first scanning signal, and, in the frame period in which the data signal of negative polarity is supplied, the third level is supplied to the second auxiliary capacitance after supplying of the first scanning signal.

15. The liquid crystal display apparatus according to claim 13, wherein the third level is a potential being the same as a potential being the first level; and the fourth level is a potential being the same as a potential being the second level.

16. The liquid crystal display apparatus according to claim 9, wherein the first control signal and the second control signal are the same scanning signal.

* * * * *